US008887430B2

(12) United States Patent
Wichner

(10) Patent No.: US 8,887,430 B2
(45) Date of Patent: Nov. 18, 2014

(54) SHOOTER AIM DETECTION AND WARNING SYSTEM

(71) Applicant: Brian Donald Wichner, Otter Rock, OR (US)

(72) Inventor: Brian Donald Wichner, Otter Rock, OR (US)

( * ) Notice: Subject to any disclaimer, the term of this patent is extended or adjusted under 35 U.S.C. 154(b) by 104 days.

(21) Appl. No.: 13/831,926

(22) Filed: Mar. 15, 2013

(65) Prior Publication Data

US 2014/0190051 A1 Jul. 10, 2014

Related U.S. Application Data

(60) Provisional application No. 61/751,242, filed on Jan. 10, 2013.

(51) Int. Cl.

| | |
|---|---|
| ***F41A 17/08*** | (2006.01) |
| ***G08B 21/18*** | (2006.01) |
| ***F41A 17/12*** | (2006.01) |

(52) U.S. Cl.

CPC ..... *G08B 21/182* (2013.01); *F41A 17/12* (2013.01)

USPC ..... 42/70.09; 42/70.01

(58) Field of Classification Search

CPC ..... F41A 17/08; F41A 17/10; F41A 17/12; G08B 21/182

USPC ..... 42/70.09, 70.01, 66, 1.05, 1.01; 89/27.12, 142, 148

See application file for complete search history.

(56) References Cited

U.S. PATENT DOCUMENTS

| | | | | |
|---|---|---|---|---|
| 4,164,165 | A * | 8/1979 | Bean et al. | 89/134 |
| 4,375,135 | A * | 3/1983 | Wigger | 42/1.01 |
| 6,785,996 | B2 * | 9/2004 | Danner et al. | 42/70.08 |
| 7,180,425 | B2 * | 2/2007 | Yuasa | 340/669 |
| 7,188,444 | B2 * | 3/2007 | Danner et al. | 42/70.09 |
| 7,356,956 | B2 * | 4/2008 | Schinazi et al. | 42/1.01 |
| 7,661,217 | B2 * | 2/2010 | Pikielny | 42/1.01 |
| 7,669,356 | B2 * | 3/2010 | Joannes et al. | 42/1.01 |
| 7,716,863 | B1 * | 5/2010 | Johnson et al. | 42/1.02 |
| 8,046,946 | B2 * | 11/2011 | Packer et al. | 42/1.01 |
| 8,109,023 | B2 * | 2/2012 | Pikielny | 42/1.01 |
| 8,176,667 | B2 * | 5/2012 | Kamal et al. | 42/1.01 |
| 8,312,660 | B1 * | 11/2012 | Fujisaki | 42/70.11 |
| 8,584,388 | B1 * | 11/2013 | Fujisaki | 42/70.11 |
| 2002/0174588 | A1 * | 11/2002 | Danner et al. | 42/70.09 |
| 2005/0279165 | A1 * | 12/2005 | Yuasa | 73/489 |
| 2006/0042142 | A1 * | 3/2006 | Sinha | 42/1.01 |
| 2006/0277808 | A1 * | 12/2006 | Danner et al. | 42/70.09 |
| 2008/0016744 | A1 * | 1/2008 | Joannes et al. | 42/1.01 |
| 2008/0052976 | A1 * | 3/2008 | Schinazi et al. | 42/1.01 |
| 2008/0282595 | A1 * | 11/2008 | Clark et al. | 42/1.01 |
| 2010/0139141 | A1 * | 6/2010 | Pikielny | 42/1.03 |
| 2010/0251586 | A1 * | 10/2010 | Packer et al. | 42/1.01 |
| 2011/0072703 | A1 * | 3/2011 | Ferrarini et al. | 42/1.01 |
| 2014/0182179 | A1 * | 7/2014 | McHale | 42/70.06 |
| 2014/0230296 | A1 * | 8/2014 | Kuparinen | 42/1.01 |

* cited by examiner

*Primary Examiner* — Peter Poon
*Assistant Examiner* — Jonathan C Weber

(57) ABSTRACT

Subject matter disclosed herein relates to an apparatus, device, or method for detecting aim or pointing direction of a firearm, the method comprising detecting a sound signature of a gunshot from the firearm; sensing an aim direction of the firearm substantially at the time of detecting the sound signature of the gunshot; setting a reference direction based, at least in part, on the aim direction; sensing a current aim direction of the firearm; comparing the current aim direction to the reference direction; and initiating an alarm if the current aim direction is beyond a threshold angle of displacement from the reference direction.

20 Claims, 16 Drawing Sheets

Other Firearm Parts bore:
Inside of the firearm barrel through which the projectile travels when fired
breech:
Rear end of the barrel
firing pin:
A pin that strikes the primer of the cartridge, causing ignition
receiver:
Metal housing for the working parts of the action

SHOOTER AIM DETECTION AND WARNING SYSTEM

This patent application claims benefit of and priority to U.S. Provisional Patent Application Ser. No. 61/751,242, filed on Jan. 10, 2013, entitled "Firearm Aim Detection and Warning System", the contents of which are incorporated herein by reference in their entirety.

BACKGROUND

1. Field

Subject matter disclosed herein relates to an apparatus and method for providing warning of a firearm aimed in an undesirable or dangerous direction.

2. Information

Firearms, such as handguns or rifles, are involved in thousands of accidental deaths or injuries per year in the United States.

One feature of firearms that may lead to a number of accidents is that aiming or pointing a firearm in any direction may be effortless: A user holding a firearm may easily, inadvertently point the firearm toward an adjacent shooter at a firing range just as easily as the user may aim at an intended target in the firing range, for example. Accordingly, many firing ranges, where shooters practice their skills at using a firearm, have strict rules regarding how to orient a firearm at all times. For example, a user inadvertently, even for a moment, pointing a firearm in a direction other than downward or at a target of a firing range may result in the user being dismissed from the firing range.

Handguns may be particularly problematic compared to rifles: It may be extremely easy to wave a handgun in any direction. Unless a user has, over years perhaps, developed careful habits for handling a firearm, a user may often need to apply extra effort while handling a firearm to ensure that the firearm is never pointing in an unintentional direction. This may hold truer for younger shooters or beginners first handling a firearm. However, more experienced shooters may become lackadaisical, careless, or even just tired.

Unfortunately, some users, perhaps because of horseplay or a dangerous sense of humor, may intentionally aim their firearm at targets or in directions that could lead to property damage, injury, or loss of life if the firearm were to be discharged.

BRIEF DESCRIPTION OF THE FIGURES

Non-limiting and non-exhaustive embodiments will be described with reference to the following figures, wherein like reference numerals refer to like parts throughout the various figures unless otherwise specified.

DETAILED DESCRIPTION

Figure 1:
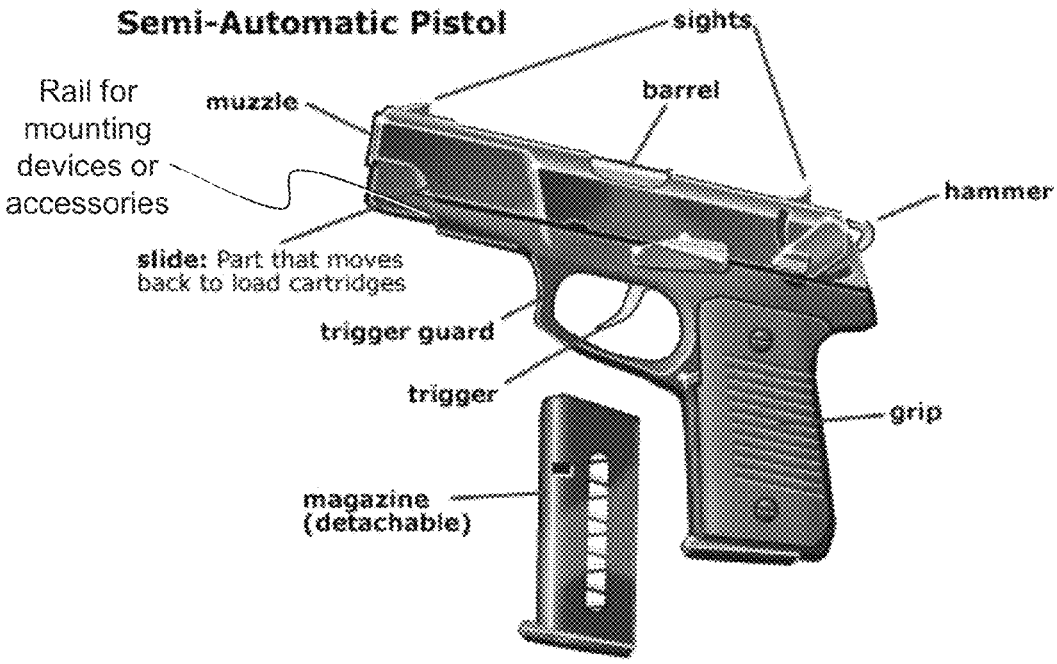
Prior Art FIG. 1
FIG. 1 is a perspective view of a semi-automatic pistol, according to an embodiment.

Reference throughout this specification to "one embodiment" or "an embodiment" means that a particular feature, structure, or characteristic described in connection with the embodiment is included in at least one embodiment of claimed subject matter. Thus, the appearances of the phrase "in one embodiment" or "an embodiment" in various places throughout this specification are not necessarily all referring to the same embodiment. Furthermore, the particular features, structures, or characteristics may be combined in one or more embodiments.

In an embodiment, a method may be used to detect aim or pointing direction of a firearm while the firearm is held and operated by a user (e.g., shooter). Aim direction of a firearm may mean a direction that a round (e.g., a bullet or shot, etc.) would travel from the firearm upon or after being discharged.

The method, which may be performed by an aim-detector-safety-device (ADSD), attached to a firearm, may comprise detecting a gunshot made by the firearm. In another implementation, an ADSD may comprise an aim-detector-device, wherein aim may be a primary concern over safety (though, practically speaking, safety of firearms is desirably of utmost importance). Though a shooter may be in control of an aim direction of a firearm, the shooter may inadvertently, from time to time, point the firearm in a dangerous direction. An ADSD may detect such a direction and warm the shooter or people near the shooter of such a dangerous direction.

An ADSD may comprise a number of components, which may be integrated together, or may be separated and located at different places. For example, in one implementation, an ADSD may comprise a processor and/or other electronics, a 3D sensor, and/or a touch sensor, which may all be integrated together and located on a firearm. In another implementation, an ADSD may comprise a processor and/or other electronics, a 3D sensor, and/or a touch sensor, wherein the 3D sensor and touch sensor may be located on a firearm while the processor and/or other electronics is located remotely from the firearm. Such components may communicate among one another via wireless signals (e.g., Bluetooth), for example. In yet another implementation, an ADSD may comprise a processor and/or other electronics, a 3D sensor, and/or a touch sensor, wherein the 3D sensor and touch sensor may be located on a firearm remotely from the processor and/or other electronics, which is also located on the firearm. Such components may communicate among one another via wireless signals (e.g., Bluetooth), or wired signals, for example.

Detecting a gunshot may comprise receiving sound waves or shock waves at a sensor (e.g., microphone, piezoelectric (PZT) device, or accelerometer, just to name a few examples), and determining whether the sound or shock waves were produced by a gunshot of the firearm. For example, the sound or shock waves may be converted (e.g., by a microphone, PZT device, accelerometer, or other transducer device) to an electronic signal comprising a sound signature. An accelerometer attached to a portion of a firearm, for example, may detect recoil of the shooting firearm. Such recoil may comprise an identifiable motion signature (e.g., firearm suddenly accelerated backward). A processor, or other electronics, of the ADSD, for example, may compare a sound signature with a number of sound signatures stored in a memory of an ADSD. Amplitude and/or frequency distribution in time or frequency space may be analyzed using code executable by a processor, for example. The particular firearm to which the ADSD is attached may produce a particular sound signature that is different from a sound signature produced by discharge of another firearm, even if the firearms are firing the same types of rounds, for example. In one implementation, a sound signature of a gunshot of the firearm to which the ADSD is attached may be different from a gunshot of another firearm because the intensity of a shock or sound wave may be greater from the gunshot produced by the firearm to which the ADSD is attached compared to other firearms in the vicinity, for example. Further, a gunshot of one firearm will not produce recoil of another firearm.

The method may further comprise sensing the aim direction of the firearm substantially at the time of detecting a gunshot (e.g., when a shooter fires the firearm). A gunshot means discharge of a firearm, so that a round (e.g., bullet or shot) is activated or discharged and the firearm fires the bullet or shot out of the firearm in the aim direction set forth by the shooter Aim direction may be sensed by a position sensor using 3D sensing technology, such as that used in Wii gaming, by Nintendo Corporation of Japan, for example. 3D sensing technology may use gyroscopic or accelerometer techniques in some examples. Single- and multi-axis models of accelerometers may detect magnitude and/or direction of acceleration (e.g., g-force), as a vector quantity, and may be used to sense orientation (e.g., because direction of weight changes), coordinate acceleration (e.g., if it produces g-force or a change in g-force), vibration, shock, and falling in a resistive medium (a case where the proper acceleration changes, since it starts at zero, then increases). In an implementation, an accelerometer, such as a micro-machined accelerometer, may be used in or by an ADSD to detect the position and/or orientation of the device.

The method may further include setting a reference aim direction based, at least in part, on the aim direction sensed when the gunshot was detected, for example. In other implementations, a reference aim direction may be manually selected by a user, or a reference aim direction may be reset upon or after a subsequent gunshot is detected. Such resetting based, at least in part, on subsequent gunshots may help to avoid undesirable accumulation errors that 3D sensors may experience over time. Accumulation errors may involve loss of accuracy of orientation with respect to a reference direction, for example.

In the method, a shooter's current aim direction of the firearm may be sensed continuously or from time to time. For example, aim direction may be sensed about a few times per second. A processor or other types of electronics in the ADSD may compare current aim direction to the reference aim direction (e.g., the aim direction of the firearm when a gunshot was fired). An alarm, which may be audible or visible to a user or other people in the vicinity, may be initiated if a current aim direction is beyond a threshold angle of displacement from the reference aim direction. Threshold angles of displacement may be defined by criteria a priori established and stored in a memory of the ADSD. Threshold angles may define aim violation directions. Threshold angles may comprise horizontal angles of displacement from a reference aim direction and may comprise angles of displacement from horizontal, as defined by gravity, for example. Herein, angles of displacement from horizontal are called azimuthal angles. For a numeric example, if a reference aim direction is defined to be at zero degrees, an aim violation may be considered to occur if the aim direction of the firearm is greater than 60 degrees horizontally to the right or to the left of the axis of the firearm. It may be clear that a gun pointing greater than 60 degrees toward the right or left of a shooter may be dangerous for persons standing to the sides of a shooter. Thus, in this case, a horizontal threshold angle may be 60 degrees. A horizontal threshold angle may depend, at least in part, on azimuthal angle. For example, if a firearm is pointing downward, than a horizontal threshold angle may increase from 60 degrees to 80 degrees, just to give some numeric examples. Different venues (e.g., shooting clubs, shooting ranges, parent teaching children to shoot, instructors teaching adults to shoot, and so on) may develop different criteria and different horizontal and azimuthal threshold angles. In such cases, dangers of a shooter aiming a firearm in a direction that violates a particular shooting club's rules, for example, may be questionable or debatable. However, an ADSD may nevertheless be useful for enforcing such rules regarding how a shooter operates or controls his firearm.

In one embodiment, an intensity of an alarm may be based, at least in part, on horizontal and/or azimuthal angles of displacement from a reference aim direction. For example, an alarm may sound at a first intensity if a current aim direction just exceeds threshold angles (e.g., if the firearm is determined to be violating aim criteria). The intensity of the alarm may increase as a horizontal and/or azimuthal angle of displacement from the reference aim direction increases. In other words, the more a firearm is violating aim criteria, the louder an alarm may be.

In one embodiment, an ADSD may be capable of, and a method may include, detecting a sound signature of a round being loaded into a chamber of a firearm. Detecting a round being loaded into a chamber may comprise receiving sound waves or shock waves at a sensor (e.g., microphone or piezoelectric (PZT) device, just to name a few examples), and determining whether the sound or shock waves were produced by a round being loaded into a chamber of the firearm. For example, the sound or shock waves may be converted (e.g., by a microphone, PZT device, or other transducer device) to an electronic signal comprising a sound signature. A processor, or other electronics, of the ADSD, for example, may compare a sound signature with a number of sound signatures stored in a memory of an ADSD. Amplitude and/or frequency distribution in time or frequency space may be analyzed using code executable by a processor, for example. The particular firearm to which the ADSD is attached may produce a particular sound signature that is different from a sound signature produced by a round being loaded into a chamber of another firearm, even if the firearms are being loaded with the same types of rounds, for example. In one implementation, a sound signature of a round being loaded into a chamber of the firearm to which the ADSD is attached may be different from a round being loaded into a chamber of another firearm because the intensity of a shock or sound wave may be greater from the round being loaded into a chamber of the firearm to which the ADSD is attached compared to that of other firearms in the vicinity, for example.

In one implementation, the intensity of an alarm may be based, at least in part, on detecting that a round is in a chamber of the firearm (e.g., detecting a sound signature of a round being loaded into a chamber of a firearm). For example, an alarm may be louder if a round is determined by the ADSD to be in the chamber of the firearm compared to the case of an empty chamber.

In one embodiment, an ADSD may be capable of, and a method may include, detecting if a finger of a user is on or near a trigger of the firearm to which the ADSD is attached. For example, as explained below, an ADSD may include a trigger finger rest pad comprising a touch sensor that a user touches while the user is not intending to touch a trigger of the firearm. In one implementation, the intensity of an alarm may be based, at least in part, on detecting if a finger is on or near a trigger of the firearm. For example, an alarm may be louder if a finger is on the trigger compared to the case where the finger is not on or near the trigger.

In some embodiments, a reference aim direction may be set by a user, and an ADSD need not have a capability to detect sounds or shocks. For example, an ADSD may initiate an alarm if a shooter's aim direction of a firearm is in an unsafe angular range, relative to a reference aim direction a priori set manually by a user.

In an embodiment, a sensor, herein called a 3D sensor, may comprise one or more accelerometers, one or more inertial sensors, and/or one or more gyroscopes (e.g., MEMS gyroscopes). Such a sensor, which may comprise a solid state chip and/or integrated circuit package may sense the following of an object that it is attached to, such as a firearm: tilt and rotation up and down; tilt and rotation left and right; rotation along a main axis (e.g., as with a screwdriver twist); acceleration up and down; acceleration left and right; acceleration toward a point and away from the point; and so on. A sensor may comprise, for example, three accelerometers to measure acceleration or displacement in each of the three orthogonal axes. Accordingly, a sensor affixed to a firearm may sense such motions or orientations relative to a reference direction, such as a particular target at a firing range, for example.

In an embodiment, MEMS inertial accelerometers may comprise a mass-spring system, which may reside in a vacuum. Exerting acceleration on the accelerometer may result in a displacement of the mass in the spring system. The displacement of the mass may depend, at least in part, on the mass-spring system, so a calibration may be needed. Readout may be via a capacitive system. MEMS accelerometers may be available in 1D, 2D and 3D versions.

In an embodiment, inertial gyroscopes may be found in various classes, such as Ring Laser Gyroscopes (RLG), Fiber Optic Gyros (FOG), and MEMS Gyroscopes. MEMS gyroscopes may comprise a small vibrating mass that oscillates at e.g. 10's of kHz. The mass may be suspended in a spring system, and readout may be via a capacitive system as it is in accelerometers. If the gyroscope is rotated, the rotation may exert a perpendicular Coriolis-force on the mass that may be larger if the mass is further away from the center of rotation. The oscillating mass thus may lead to a different read-out on either side of the oscillation, which may be a measure for rate of turn.

In an embodiment, some commercial devices, such as piezoelectric, piezoresistive, and/or capacitive components may be used to convert mechanical motion into an electrical signal. Piezoelectric accelerometers may use piezoceramics (e.g. lead zirconate titanate) or single crystals (e.g. quartz, tourmaline). Piezoceramics may be desirable in terms of their upper frequency range, low packaged weight and high temperature range. Piezoresistive accelerometers may be desirable for high shock applications. Capacitive accelerometers may use a silicon micro-machined sensing element. Their performance may be desirable in a low frequency range and they may be operated in servo mode to achieve high stability and linearity, for example.

In an embodiment, accelerometers may comprise relatively small micro electro-mechanical systems (MEMS), and may include a cantilever beam with a proof mass (also known as seismic mass). Damping may result from residual gas sealed in the device. As long as the Q-factor is not too low, damping need not result in a lower sensitivity. Under the influence of external accelerations the proof mass may deflect from its neutral position. This deflection may be measured in an analog or digital manner. For example, the capacitance between a set of fixed beams and a set of beams attached to the proof mass may be measured. Integrating piezoresistors in the springs to detect spring deformation, and thus deflection, may be a good alternative, although a few more process steps may be involved during a fabrication sequence.

In an embodiment, micromechanical accelerometers may operate in-plane, that is, they may be designed to be sensitive only to a direction in a plane of the die. By integrating two devices perpendicularly on a single die, a two-axis accelerometer may be made. By adding an additional out-of-plane device three axes may be measured. Such a combination may have lower misalignment error than three discrete models combined after packaging. Micromechanical accelerometers may be commercially available in a wide variety of measuring ranges, reaching up to thousands of g's. A designer may face a compromise between sensitivity and maximum acceleration that may be measured.

A 3D sensor may be relatively small, and mountable on a firearm. The 3D sensor may include a transmitter to transmit wireless electronic signals to an ADSD. For example, a 3D sensor may be about the size of a thick coin (e.g., about 2 centimeters diameter and about 0.5 or 1.0 centimeters thick), or about the size of a small cube (e.g., about 2.0 cubic centimeters), just to give a few examples. Of course, a sensor may have any dimensions, and claimed subject matter is not so limited to any particular sizes or shapes. A 3D sensor may include a self-adhesive portion so that the 3D sensor may be affixed to a portion of a firearm using an adhesive, such as shown in FIG. 6C.

An ADSD may provide a number of benefits. For example, beginning shooters at firing ranges may have a dangerous habit or lack of discipline of pointing a gun in directions other than a general direction of a target. An ADSD may reinforce good habits of shooters by sounding an alarm if the shooter aims the firearm in a dangerous direction. Moreover, an ADSD may help to reinforce good habits of a shooter by silencing an alarm in response to the shooter correcting his/her aim to a safe direction (e.g., toward a target of a shooting range). Accordingly, interaction of the behavior of an ADSD with the behavior of a shooter may teach the shooter safe firearm practices.

An ADSD may be considered as a teaching tool for teachers or a self-teaching tool for students or beginning shooters. An ADSD may provide a benefit to shooting instructors in teaching safe shooting skills to students. For example, an instructor's attention need not be mostly limited to observing a single student's aim of a firearm. An ADSD may assist an instructor by sounding an alarm if one of one or more students aims a gun in a dangerous direction: The instructor may hear the alarm of a dangerous aim of a gun even if the instructor did not see such an aim occur. Also, in another example, an ADSD may record aim violations (e.g., number of occurrences) so that an instructor may evaluate a student at the "end of a day". Of course, such benefits are merely examples, and claimed subject matter is not so limited.

FIG. 1 is a perspective view of a firearm comprising a semi-automatic pistol, according to an embodiment. Various parts and portions are named in the figure. Well-known in the art, various brackets may be attached to the pistol to mount a device above the slide, for example.

Figure 2:
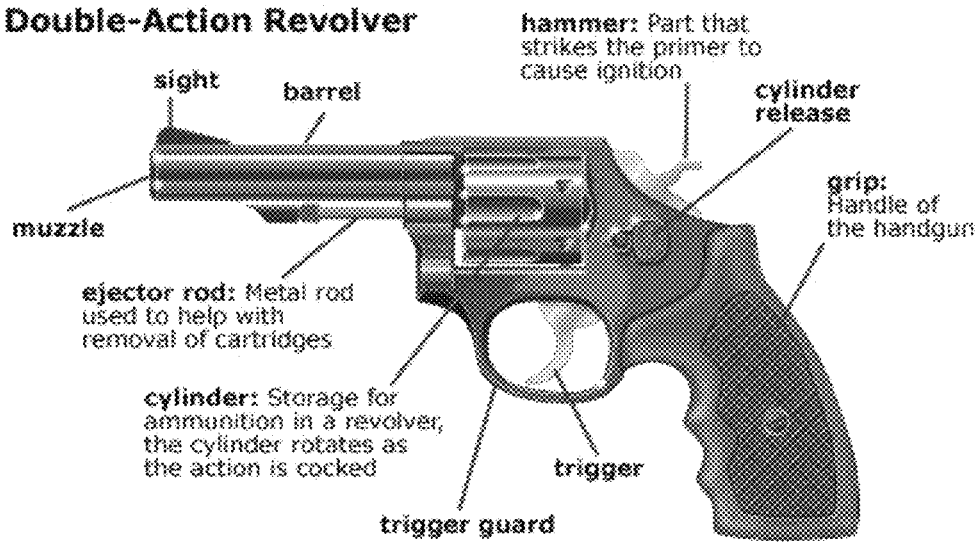
Prior Art FIG. 2
FIG. 2 is a perspective view of a revolver, according to an embodiment.

FIG. 2 is a perspective view of a firearm comprising a revolver, according to an embodiment. Various parts and portions are named in the figure.

Figure 3:
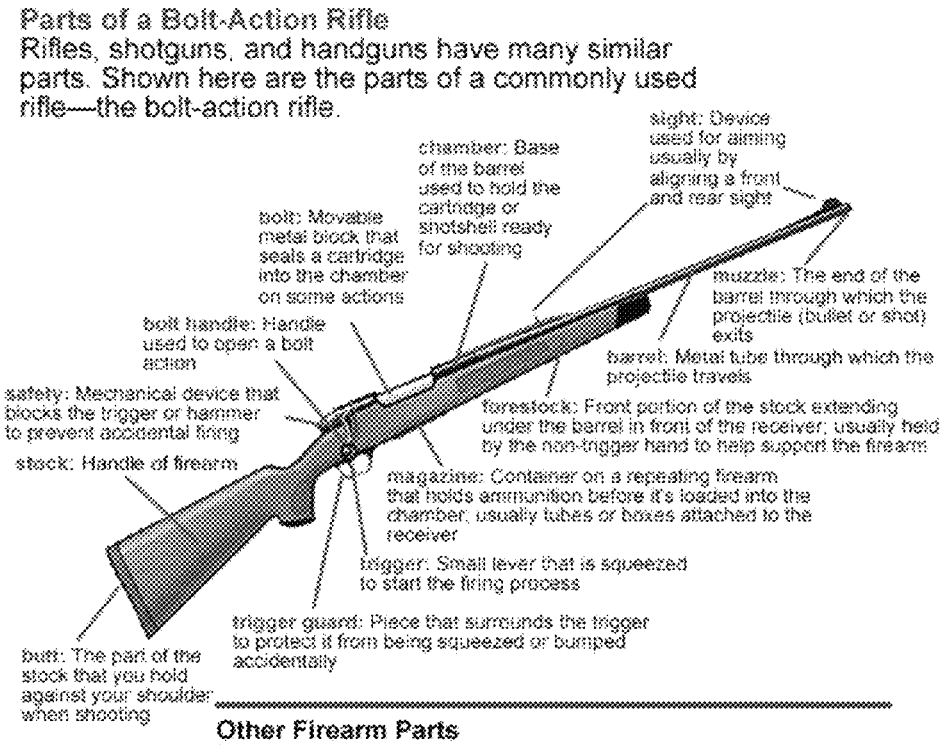
Prior Art FIG. 3
FIG. 3 is a side view of a bolt-action rifle, according to an embodiment.

FIG. 3 is a side view of a firearm comprising a bolt-action rifle, according to an embodiment. Various parts and portions are named in the figure.

Figure 4:
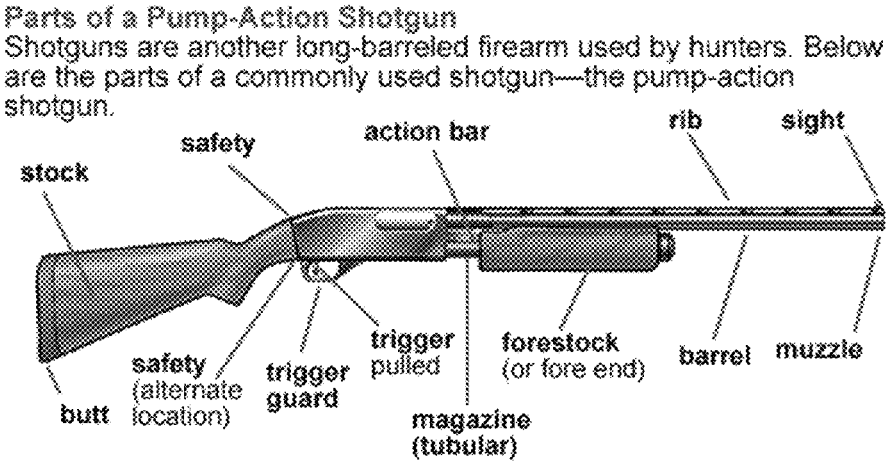
Prior Art FIG. 4
FIG. 4 is a side view of a shotgun, according to an embodiment.

FIG. 4 is a side view of a firearm comprising a shotgun, according to an embodiment. Various parts and portions are named in the figure.

Figure 5:
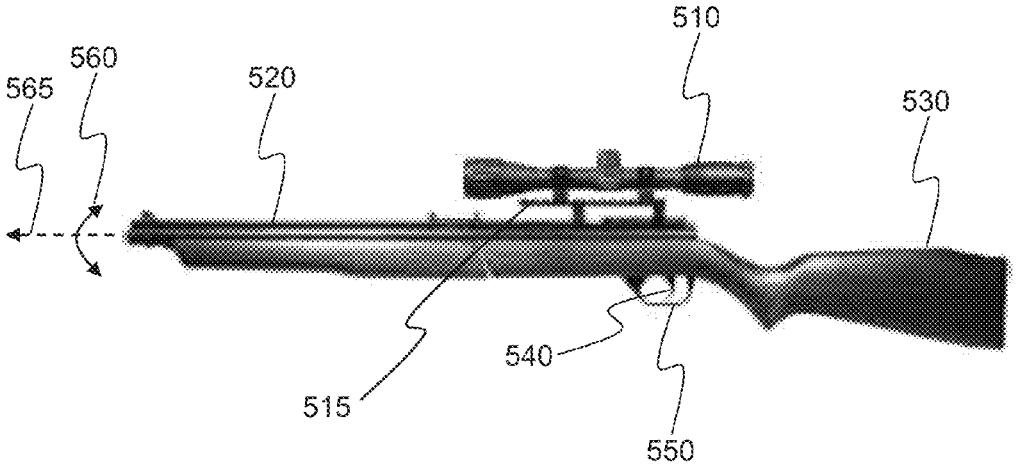
Prior Art FIG. 5
FIG. 5 is a side view of a rifle with a scope, according to an embodiment.

FIG. 5 is a side view of a firearm comprising a rifle with a scope 510 mounted on a bracket 515, according to an embodiment. The rifle includes a barrel 520, trigger guard 550, trigger 540, and stock 530, for example. Arrow 560 indicates a possible rotation about an aim direction 565. Rotations orthogonal to that shown are possible as well.

Figure 6A:
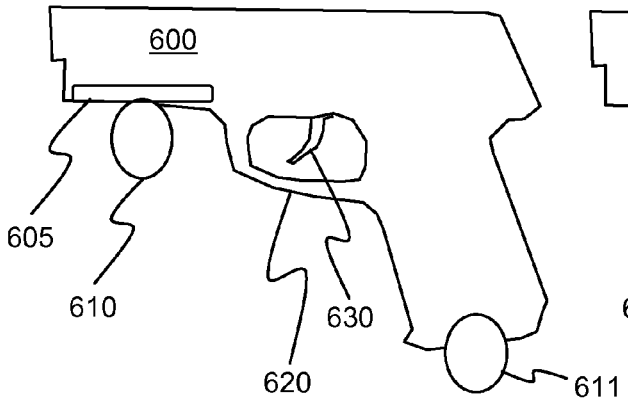
FIGS. 6A and 6B are schematic side-view diagrams illustrating a handgun with an attached aim-detector-safety-device (ADSD), according to an embodiment.
Figure 6B:
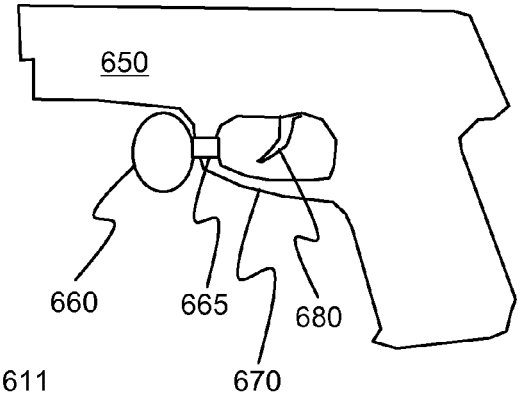
Figure 6C:
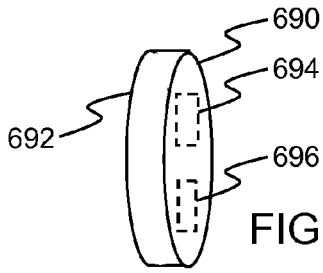
FIG. 6C is a schematic perspective view of a 3D sensor, according to an embodiment.

FIGS. 6A and 6B are schematic side-view diagrams illustrating a firearm comprising a handgun 600 with an attached ADSD/ADSD sensor, according to an embodiment. Either an ADSD, one or more sensors of the ADSD, or both may be indicated by "ADSD/ADSD sensor". For example, handgun 600 may include a trigger guard 620, a trigger 630, and a mounting rail 605. An ADSD/ADSD sensor 610 may be mounted on any portion of a firearm, such as on rail 605, magazine (FIG. 1), grip (FIG. 1), and so on, for example. Though an ADSD/ADSD sensor is depicted as having an oval shape, this is only schematic, and an ADSD/ADSD sensor may have any shape, such as rectangular, partially angled, etc. Size may be anywhere from a cubic centimeter to a cubic inch or more, and claimed subject matter is not so limited. A mounting rail 605, such as on a Glock (Glock manufacturer in Austria), for example, may be present on some pistols and not others. In another implementation, an ADSD/ADSD sensor 611 may be attached to a magazine, for example.

Handgun 650, for example, need not include a mounting rail. Handgun 650 may include a trigger guard 670, and a trigger 680. An ADSD/ADSD sensor 660 may include a bracket or clamp 665 or other connection means to be mounted on any portion of a firearm, such as on trigger guard 670. In another implementation, an ADSD/ADSD sensor need not include a mounting bracket or such hardware: an ADSD/ADSD sensor may be self-adhesive, or associated sensors (e.g., 3D sensor, touch sensor, etc.) may be self adhesive.

FIG. 6C is a schematic perspective view of a 3D sensor 690, according to an embodiment, and may be relatively small and mountable on a firearm (e.g., a rifle or handgun, such as 600) or another object (e.g., scope, telescope mount, flashlight, brackets, rails, sights, magazines, clips, laser mounts, foregrips, butt stocks, bi-pods, and so on) that is mounted on the firearm. The 3D sensor may include one or more accelerometers or inertial sensors 694 and/or a transmitter 696 to transmit wireless electronic signals to an ADSD. For example, a 3D sensor may be about the size of a thick coin (e.g., about 2 centimeters diameter and about 0.5 or 1.0 centimeters thick), or about the size of a small cube (e.g., about 2.0 cubic centimeters), just to give a few examples. Of course, a sensor may have any dimensions, and claimed subject matter is not so limited to any particular sizes or shapes. A 3D sensor may include a self-adhesive portion 692 so that the 3D sensor may be affixed to a portion of a firearm using an adhesive, such as shown in FIG. 6C. Similarly, an ADSD may include a self-adhesive portion so the ADSD may be affixed to a firearm. In one implementation, a 3D sensor may include a clamp to clamp onto a portion of a firearm.

Figure 7:
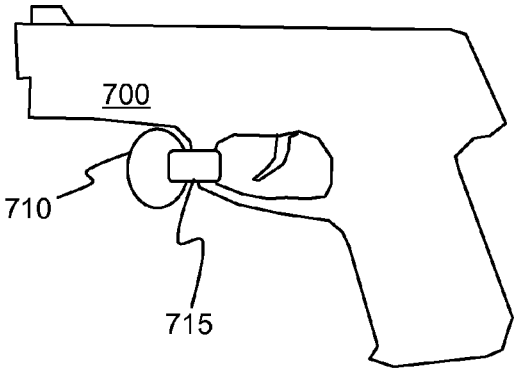
FIG. 7 is a schematic side-view diagram illustrating a handgun with an attached ADSD that includes a touch sensor, according to an embodiment.

FIG. 7 is a schematic side-view diagram illustrating a firearm comprising a handgun 700 with an attached ADSD/ADSD sensor 710 that includes a finger trigger rest pad comprising a touch sensor 715, according to an embodiment. (A clamp or bracket may be concealed by touch sensor 715 in FIG. 7). Touch sensor 715 may comprise any material such as a metal or semiconductor, and may use capacitive techniques to detect touch, such as by a trigger finger of a user, for example. In one implementation, a trigger of a firearm may be manufactured so that the trigger may sense touch. In such a case, an electronic signal may be generated by the trigger to indicate whether or not the trigger is being touched. In another implementation, a trigger sensor may measure rate of trigger pull, length of held trigger position, and so on. Such measurements may be converted to electronic signals (which may be wireless signals) so that a processor receiving the signals may determine trigger pull consistencies and/or irregularities of a shooter.

Figure 8:
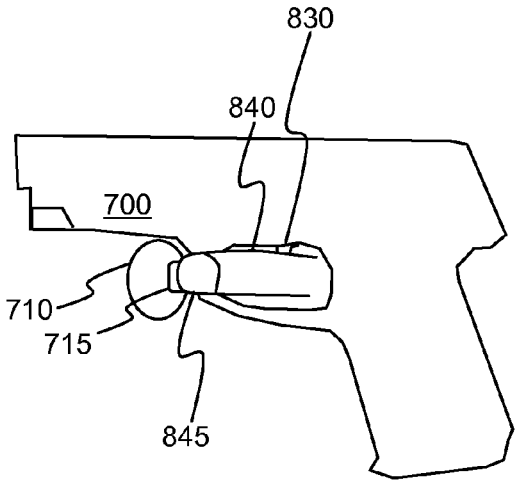
FIG. 8 is a schematic side-view diagram illustrating a handgun with an attached ADSD that includes a touch sensor showing a finger touching the touch sensor, according to an embodiment.

FIG. 8 is a schematic side-view diagram illustrating handgun 700 with attached ADSD/ADSD sensor 710 that includes touch sensor 715, showing a trigger finger 840 touching the touch sensor, according to an embodiment. Fingernail 845 of trigger finger 840 is shown for reference. In the finger position shown in the figure, trigger finger 840 may be touching touch sensor 710 and therefore may not be touching trigger 830. If the user (e.g., shooter) chooses to fire handgun 700, then the user may remove his trigger finger 840 from the touch sensor and place trigger finger 840 on trigger 830. Device 710 may detect that trigger finger 840 is no longer touching touch sensor 715. An assumption or determination may then be made by ADSD/ADSD sensor 710 that there is a likelihood that a user has his trigger finger on the trigger, for example.

Figure 9:
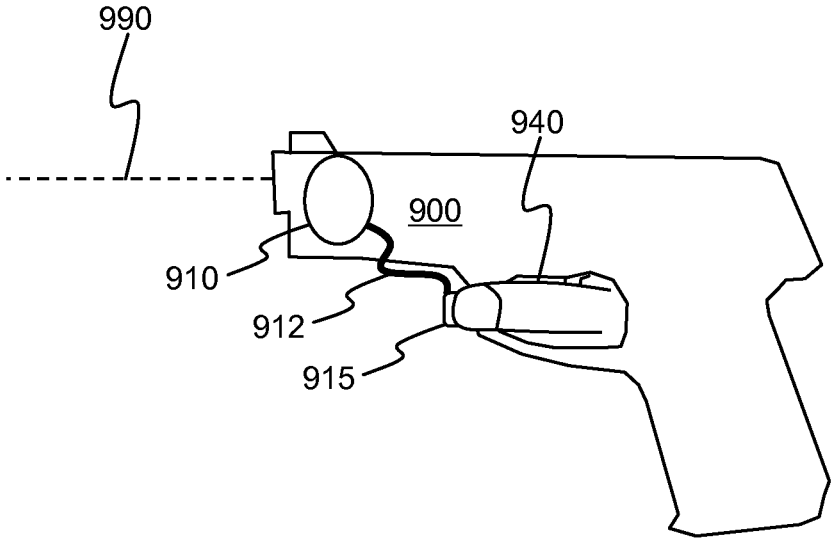
FIG. 9 is a schematic side-view diagram illustrating a handgun with an attached ADSD and wiring for communication with a remote touch sensor, showing a finger touching or near the touch sensor, according to an embodiment.

FIG. 9 is a schematic side-view diagram illustrating a handgun 900 with an attached ADSD 910 and wiring 912 for communication with a remote touch sensor 915, showing a finger 940 touching or near the touch sensor, according to an embodiment. An axis 990 of handgun 900 is shown for reference. This situation may be similar to that shown in FIG. 8, except that ADSD 910 may be located at a portion of a firearm different from a location of a touch sensor. A wire, which may comprise any number of individual conductors, for example, may be used for electronic communication between ADSD 910 and touch sensor 915. In one implementation, such electronic communication between ADSD 910 and touch sensor 915 may be performed via wireless communication in lieu of wiring 912, for example. Such electronic communication between an ADSD and a touch sensor may be performed via wireless or wired communication of a handgun or rifle, and distances between an ADSD and touch sensor may range from millimeters to several feet, for example.

Figure 10:
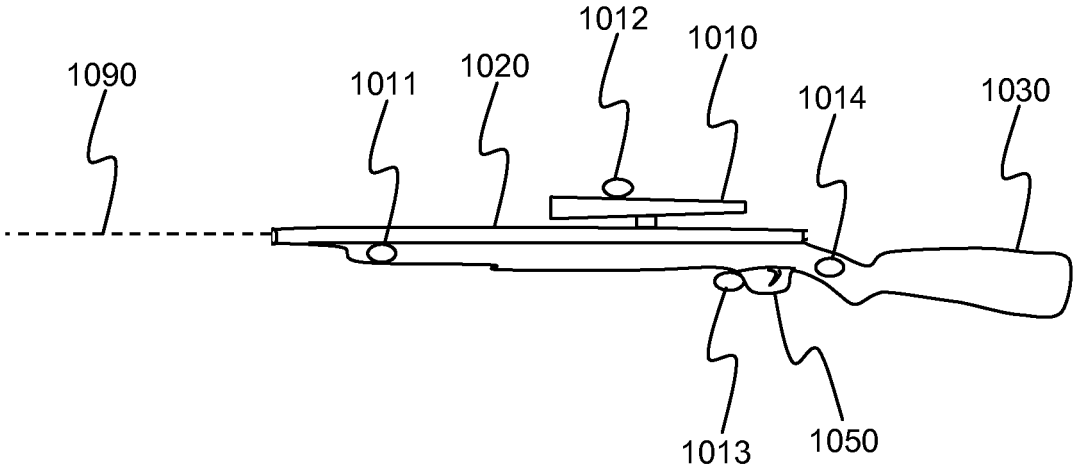
FIG. 10 is a schematic side-view diagram illustrating several possible locations of attachment of a ADSD on a rifle, according to an embodiment.

FIG. 10 is a schematic side-view diagram illustrating several possible locations of attachment of an ADSD/ADSD sensor on a rifle 1000, according to an embodiment. An axis 1090 of rifle 1000 is shown for reference. For example, an ADSD/ADSD sensor may be located at 1011, at the forestock or under the barrel 1020 of rifle 1000. Or an ADSD/ADSD sensor may be located at 1012, on a scope 1010 of rifle 1000. Or an ADSD/ADSD sensor may be located at 1013, on or near trigger guard 1050 of rifle 1030. Or an ADSD/ADSD sensor may be located at 1014, at a portion of the stock 1030 of rifle 1000. If a touch sensor is used with an ADSD in FIG. 10, then a wire may extend from a touch sensor at a region of the trigger guard 1050 to any of the locations where the ADSD may be mounted to rifle 1000, for example. Or wireless communication may be used between the touch sensor and the ADSD.

Figure 11:
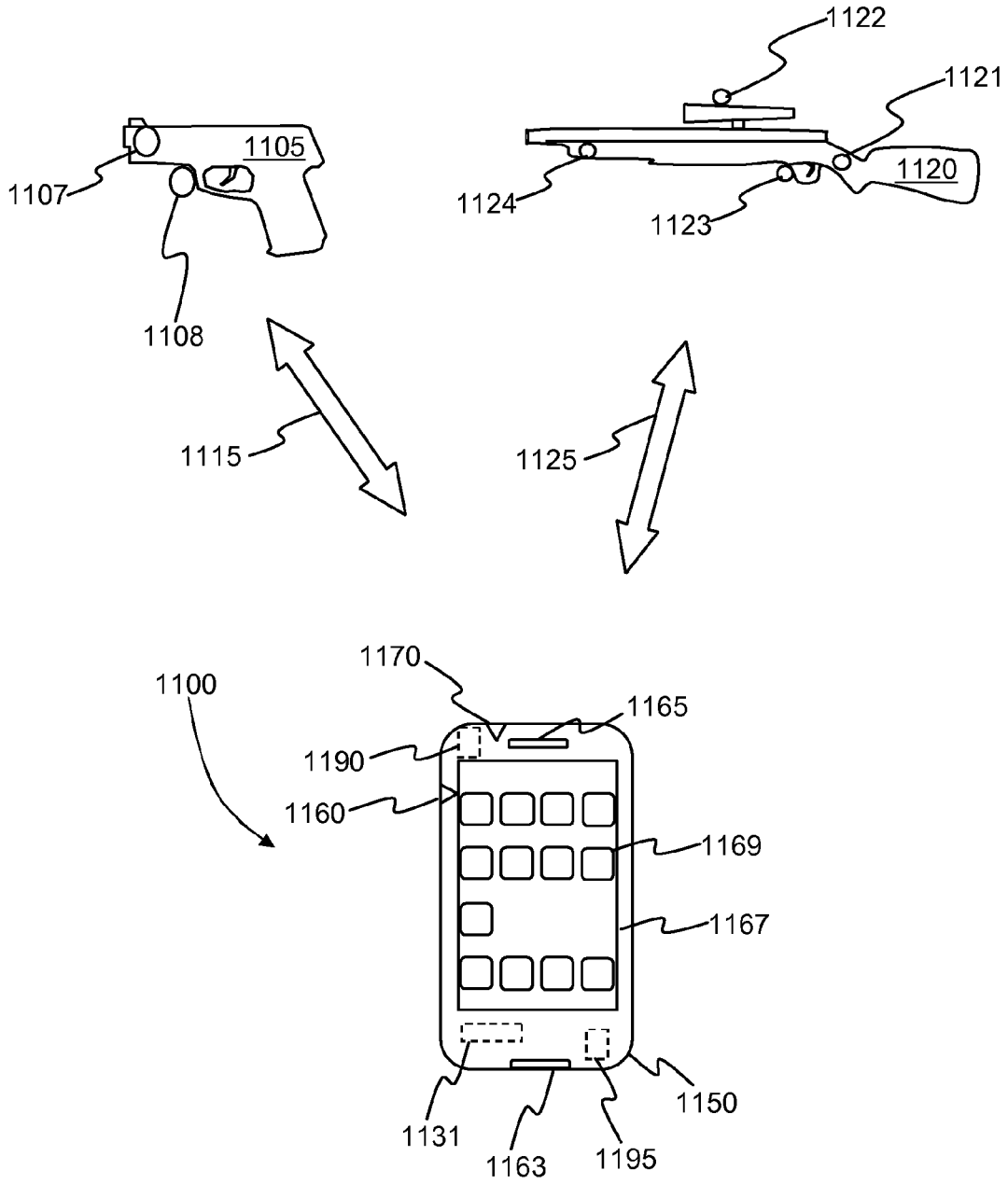
FIG. 11 is a schematic diagram illustrating several possible locations of attachment of a sensor for an ADSD on a rifle and a handgun, according to embodiments.

FIG. 11 is a schematic diagram illustrating several possible locations of attachment of a sensor for an ADSD on a rifle and a handgun, according to embodiments. An ADSD need not be located on a firearm. For example, an ADSD may be located remotely from a firearm (e.g., in a user's pocket several feet away, or further), wherein the ADSD uses one or more position sensors mounted on the firearm. For example, position sensors may comprise one or more accelerometers, which may be of any size, such as the size of a coin. Accordingly, a number of example locations of where a position sensor may be mounted on a firearm are shown in FIG. 11. A position sensor 1107 may be located at 1107 or 1108 on handgun 1105. A position sensor may be located at 1121, 1122, 1123, or 1124 on rifle 1120. Position sensors may wirelessly communicate with an ADSD 1100, as indicated by arrows 1115 and 1125. In one implementation, an ADSD may comprise a server, computer, or laptop, or other similar electronic device. In another implementation, an ADSD may comprise a smartphone, mobile phone, touch pad, laptop, or other portable (or non-portable) electronic device. Herein, a "smartphone" means a portable electronic device comprising a processor, memory, phone, or other functional components (e.g., camera, and so on). In some example embodiments described below, ADSD 1100 is considered to comprise a smartphone for illustrative purposes, but claimed subject matter is not so limited. Smartphone 1100 may comprise speaker 1165, touchscreen 1167, softkeys or adjustment sliders 1169 displayed in touchscreen 1167, or a connector (e.g., for battery charging or other functions) 1163. Though details of a smartphone are given, ADSD 1100 may comprise another type of electronic device, and claimed subject matter is not limited in this respect. ADSD 1100 may comprise an input port 1160 to receive signals representative of position of a firearm, as measured by position sensors attached to the firearm, for example. In some implementations, an input port may comprise a wireless receiver (e.g., Bluetooth) or a mini- or micro-USB port or other wired connection to connect non-wirelessly between position sensors and ADSD 1100. In one implementation, ADSD 1100 may wirelessly receive signals from position sensors via a receiver/transmitter 1190 and store representations of the signals in memory 1195, for example.

An output port 1170 may comprise a wireless transmitter, mini- or micro-USB port or other wired connection, or a headphone jack (e.g., monaural or stereo). The device may further comprise electronics 1131 configured to perform processes of detecting a shooter's aim direction of a firearm and initiating a warning of an aim violation. For example, electronics 1131 may comprise a processor configured to execute code to perform processes, such as 1700, described herein. ADSD 1100 may be capable of monitoring positions, aim directions, and so on of more than one shooters' firearm at a time, for example, and claimed subject matter is not limited in this respect. For example, ADSD 1100 may be able to keep track of more than one shooters' firearm at a time, and maintain respective data associated with individual firearms.

ADSD 1100, comprising a Smartphone, for example, may include an application (e.g., executable code) to enable the Smartphone to perform tasks and process, such as 1700. ADSD 1100 may further communicate with a touch sensor mounted on a firearm (or touch sensors mounted on multiple firearms), in addition to position sensors mounted on the firearm (or firearms). As mentioned above, an ADSD need not involve a touch sensor, but if an ADSD does involve a touch sensor, a Smartphone operating as an ADSD may wirelessly receive signals from a touch sensor that indicate whether a user's trigger finger is touching the sensor.

In the embodiment described above, a shooter may operate a firearm that includes a position sensor mounted on the firearm. Then an ADSD may be placed in a pocket of the shooter or on a person near the shooter (e.g., a shooting instructor). Though a Smartphone was described above in example embodiments, an ADSD need not comprise a Smartphone, but may comprise an electronic device dedicated to operating as an ADSD, for example.

Figure 12:
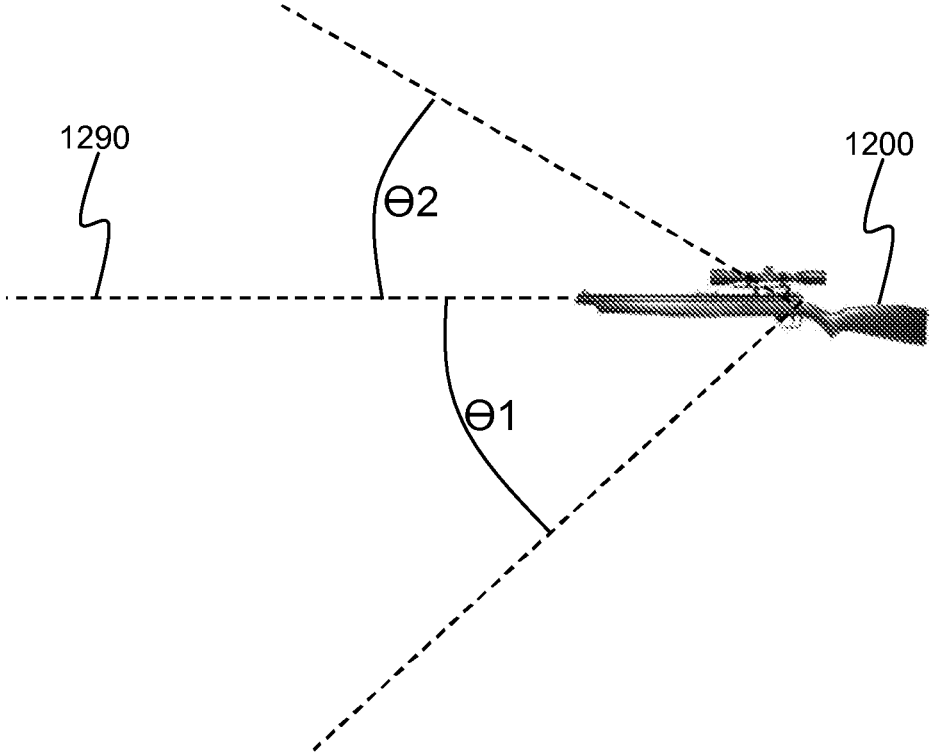
FIG. 12 is a schematic side-view diagram of a rifle and angles subtended from a reference aim direction, according to an embodiment.

FIG. 12 is a schematic side-view diagram of a rifle 1200 and angles subtended from horizontal or a reference aim direction 1290, according to an embodiment. For example, angle θ1 may comprise an azimuthal angle above horizontal (as defined by gravity), and θ2 may comprise an azimuthal angle below horizontal. Accordingly, for example, if θ1 is 30 degrees, then the shooter's aim direction of rifle 1200 may be 30 degrees below horizontal. As another example, if θ2 is 90 degrees, then the aim direction of the shooter's rifle 1200 may be straight up in the air, at 90 degrees above horizontal. A position sensor may sense such azimuthal angles to enable an ADSD to determine aim direction of a firearm.

Figure 13:
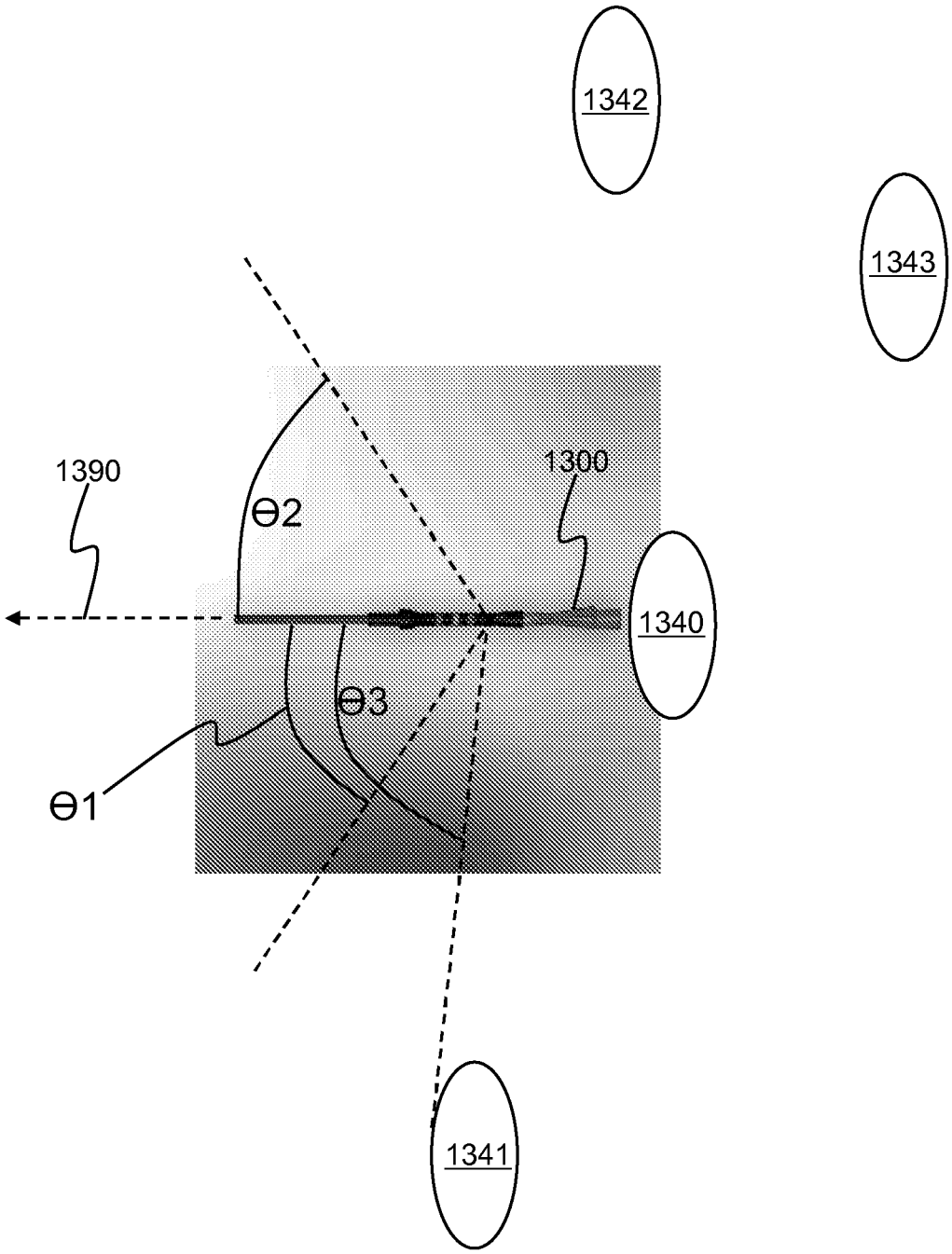
FIG. 13 is a schematic top-view diagram of a rifle and angles subtended from a reference aim direction, according to an embodiment.

FIG. 13 is a schematic top-view diagram of a rifle 1300 and angles subtended from a reference aim direction, according to an embodiment. For example, angle θ1 may comprise a horizontal (as defined by gravity) angle to the left (looking downward) of a reference aim direction 1390, and θ2 may comprise a horizontal angle to the right of the reference aim direction 1390. Reference aim direction may be determined or defined by any of a number of ways, such as manually defined by a user (e.g., shooter) or may be set as the direction of a gunshot, wherein the gunshot is detected and the direction of the firearm at the time of the gunshot may be considered or defined to be the reference aim direction. Accordingly, for example, if θ1 is 30 degrees, then the aim direction of rifle 1300 may be 30 degrees to the left of a target. As another example, if θ2 is 90 degrees, then the aim direction of rifle 1300 may be toward the right of the shooter, at 90 degrees to the right of the target. A position sensor may sense such horizontal angles to enable an ADSD to determine aim direction of a firearm.

An ADSD may use a combination of azimuthal and horizontal angles to define a shooter's aim direction of a firearm. Accordingly, for example, an aim direction of a firearm may be defined using both azimuthal and horizontal angles. A shooter's aim violations may be defined by the combination of both azimuthal and horizontal angles—merely one of these angles may not be sufficient to determine whether a firearm is pointed in a dangerous direction, for example. In an implementation, for an individual value of azimuthal angle, there may be a range of horizontal angles that may be considered in a safe zone for particular criteria. For example, at azimuth of zero degrees (e.g., firearm at horizontal aim direction), safety criteria may specify that a safe range of horizontal angles is between 70 degrees to the left and 70 degrees to the right. However, at azimuth of 80 degrees below horizontal, safety criteria may specify that a safe range of horizontal angles is between 90 degrees to the left and 90 degrees to the right. For example, the range of safe horizontal angles may increase as a firearm is pointed increasingly downward.

Different shooting venues (e.g., different shooting clubs, shooting ranges, open area, outdoors, and so on) may abide by different safety criteria. For example, one shooting club may forbid a shooter's firearm to be pointed upward as a "neutral" position, preferring instead to have a firearm pointed downward toward the ground. On the other hand, another shooting club may allow a shooter to point a gun upward or downward as a "neutral" position. One shooting range may prefer a shooter's firearm aim to be limited to a horizontal angular range within 60 degrees of a target, while another shooting range may relax such a limitation to a horizontal angular range up to 80 degrees of a target, just to name some examples. An ADSD may store in its memory multiple safety criteria for a number of types of venues. A user may manually select the proper safety criteria for the current shooting venue. In another implementation, an ADSD may automatically (e.g., without user input or action) select proper safety criteria by determining where the ADSD is located. For example, an ADSD, for example if the ADSD comprises a Smartphone, may determine its location using a satellite position system, WiFi, Bluetooth, wireless signal strength heatmaps, triangulation of access point signals, and so on. The ADSD may correlate its determined position with locations of particular venues stored in its memory. Thus, for example, an ADSD may determine that it is located at particular latitude/longitude coordinates, find a match of these coordinates with a location of a shooting range, and select safety criteria for the shooting range. In another implementation, an ADSD may receive wireless signals transmitted by an access point or other transmitter at a venue: the wireless signals may comprise information regarding safety criteria used at the venue. The ADSD may download the safety criteria to its memory or may receive a code that indicates to the ADSD which criteria (which may already be stored in memory of the ADSD) to use for the venue.

Figure 14:
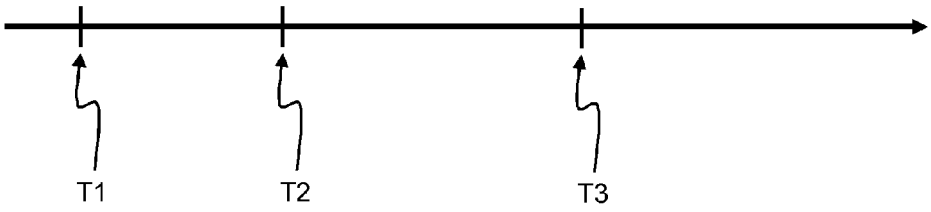
FIG. 14 is a time line of a process of detecting aim direction of a firearm and initiating a warning of an aim violation, according to an embodiment.

FIG. 14 is a time line of a process of detecting aim direction of a firearm and initiating a warning of an aim violation, according to an embodiment. For example, at T1, an ADSD may detect a gunshot, and at about this time may determine a shooter's aim direction of the firearm and thus define that direction as a reference aim direction. Thereafter, the ADSD may continuously, from time to time, or at time intervals sense a shooter's current aim directions of the firearm. Current aim directions may be compared to the reference aim direction to monitor whether or not the firearm is aimed in a safe zone, according to safety criteria. If the firearm is outside such safe zones, then an alarm may be initiated to alert the shooter or persons nearby. The alarm may stop sounding if the firearm aim direction returns to the safe zone. Or, in other implementations, the alarm may continue until a user presses a button to hush or reset the alarm, for example.

In one implementation, subsequent shots may be fired, but the reference aim direction will not change. In another implementation, the reference aim direction may be reset with each subsequent shot, or perhaps every third shot, or every tenth shot, etc., just to give a few examples. Thus, at T2, a subsequent shot may be used to reset the reference aim direction: the new reference aim direction may comprise the aim direction at the time of the subsequent gunshot, for example. At T3, another subsequent shot may again be used to reset the reference aim direction.

Figure 15:
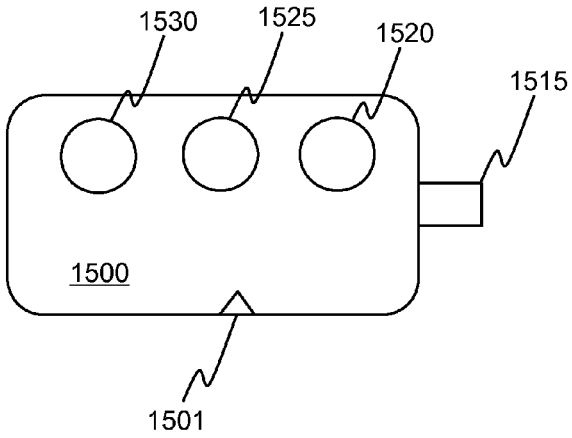
FIG. 15 is a schematic view of a ADSD including a mounting clamp or other means for mounting to a firearm, according to an embodiment.

FIG. 15 is a schematic view of a ADSD 1500 including a mounting clamp 1515 or other means for mounting to a firearm, according to an embodiment. Of course, such a clamp or other mounting means may be located on any portion of ADSD 1500. ADSD 1500 may include one or more buttons 1520 to allow a user to reset reference aim direction, select safety criteria, hush or test alarms, and so on. An output 1525 may comprise an alarm, which may in turn comprise a speaker or a light, such as a light emitting diode (LED), for example. Output 1525 may also comprise a display or LED indicator lights to allow a user to determine various status issue of the ADSD, such as battery life, on/off, safety criteria being used, memory contents, and so on. Input 1530 may comprise a speaker to receive sound or shock waves from gunshots, sounds of a round being loaded into a chamber of a firearm, and so on. In one implementation, input 1530 may comprise an accelerometer, which may be used by a processor or other electronics to detect shock waves from a gunshot. A PZT may also be used by a processor to detect shock waves also. Other sensor types may be used, and claimed subject matter is not so limited. ADSD 1500 may include a USB port 1501 for transferring electronic signals representing shooting history, shooting statistics, safety criteria, and so on.

Figure 16:
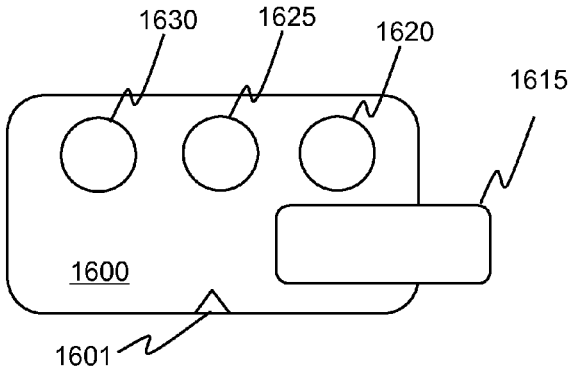
FIG. 16 is a schematic view of a ADSD including a touch sensor, according to an embodiment.

FIG. 16 is a schematic view of a ADSD 1600 including a touch sensor 1615, according to an embodiment. In other embodiments, a touch sensor may be located remotely from an ADSD. In one example, a touch sensor may be located at or near a trigger guard of a firearm and an ADSD may be located on another portion of the firearm. The ADSD and the touch sensor may communicate with one another via a wire or wireless signals, for example. In another example, a touch sensor may be located at or near a trigger guard of a firearm and an ADSD may be located remote from the firearm, such as on a table surface or in a pocket of a shooter of nearby person. The ADSD and the touch sensor may communicate with one another via wireless signals, for example. In the case shown in FIG. 16, the touch sensor 1615 is attached to the ADSD 1600.

As explained for ADSD 1500, ADSD 1600 may include one or more buttons 1620 to allow a user to reset reference aim direction, select safety criteria, hush or test alarms, and so on. An output 1625 may comprise an alarm, which may in turn comprise a speaker or a light, such as a light emitting diode (LED), for example. Output 1625 may also comprise a display or LED indicator lights to allow a user to determine various status issue of the ADSD, such as battery life, on/off, safety criteria being used, memory contents, and so on. Input 1630 may comprise a speaker to receive sound or shock waves from gunshots, sounds of a round being loaded into a chamber of a firearm, and so on. ADSD 1600 may include a USB port 1601 for transferring electronic signals representing shooting history, shooting statistics, safety criteria, and so on.

Figure 17:
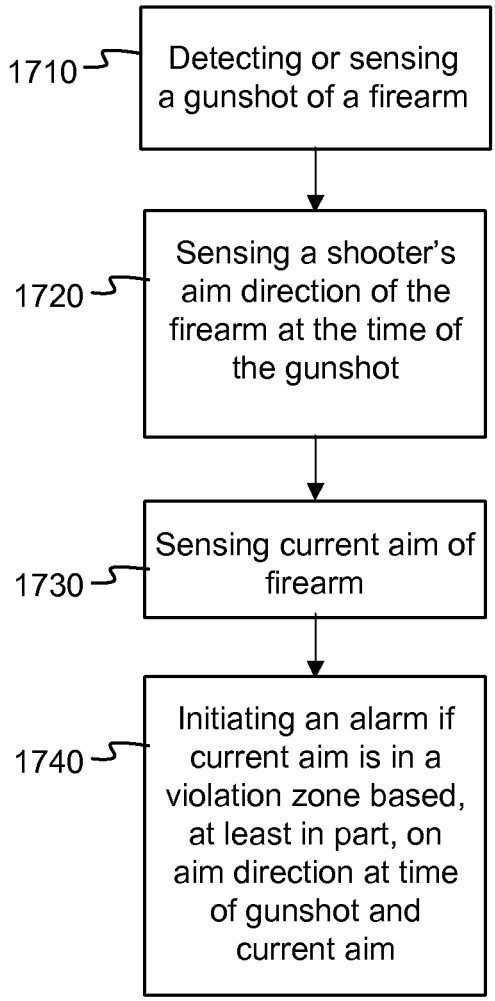
FIG. 17 is a flow diagram of a process for detecting aim direction of a firearm and initiating a warning of an aim violation.

FIG. 17 is a flow diagram of a process for detecting aim direction of a firearm and initiating a warning of an aim violation. At block 1710, a sensing device, such as an accelerometer mounted on one or more locations on a firearm, may be used to detect or sense a gunshot performed by the firearm. Other gunshots performed by other firearms in the area, for example, may be ignored. A gunshot from the firearm having the sensor may be sensed at a higher intensity compared to a gunshot from another firearm, for example. Also, sound signatures of gunshots from respective firearms may be recognizable by an ADSD. At block 1720, a sensing device, such as an accelerometer mounted on one or more locations on a firearm, may be used to detect or sense a shooter's aim direction of the firearm when the gunshot was detected. This aim direction at the time of the gunshot may then be used as a reference aim direction. At block 1730, the firearm aim direction may be sensed at time intervals, such as some number per second (e.g., sample rate at once per second, twice per second, ten times per second, or more or less frequently). Such sensing may be automatic, with no user action, for example. At block 1740, an alarm may be initiated, for example by a processor or other electronics, if an aim direction is sensed or determined (e.g., by a processor or other electronics using one or more sensors, such as an accelerometer) to violate safety criteria, which may specify, for example, ranges of aim angles that are safe or are not safe. Angles of aim direction may be determined relative to the reference aim direction, for example.

FIGS. 18-23 are schematic side views of a round and a firing pin and actuating means of a firearm to defeat or allow discharge of the round, according to embodiment. It may be desirable to defeat a shooting capability of a firearm if the firearm is aimed in a direction that violates safety criteria.

Figure 18:
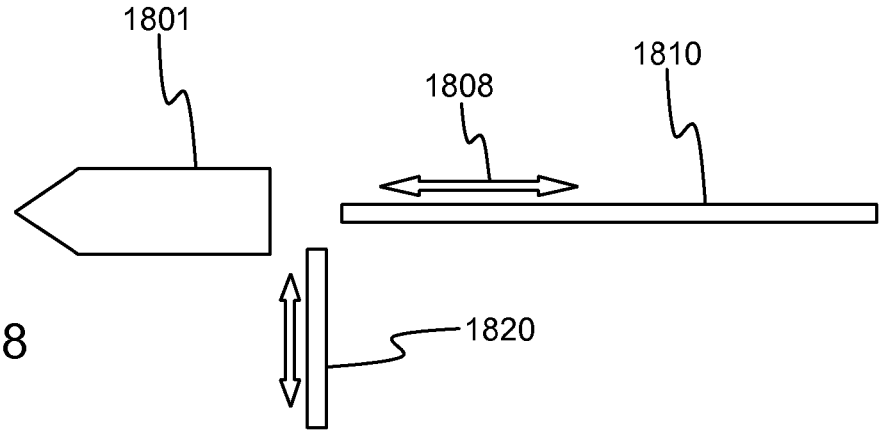
FIGS. 18-23 are schematic side views of a round and a firing pin and actuating means to defeat or allow discharge of the round, according to embodiments.

In FIG. 18, a firing pin 1810 of a firearm may move according to arrow 1808 in a direction so as to strike round (e.g., bullet) 1801. A blocking element 1820 may move in a direction so as to block or otherwise prevent firing pin 1810 from striking round 1801, thus preventing discharge of the firearm.

Figure 19:
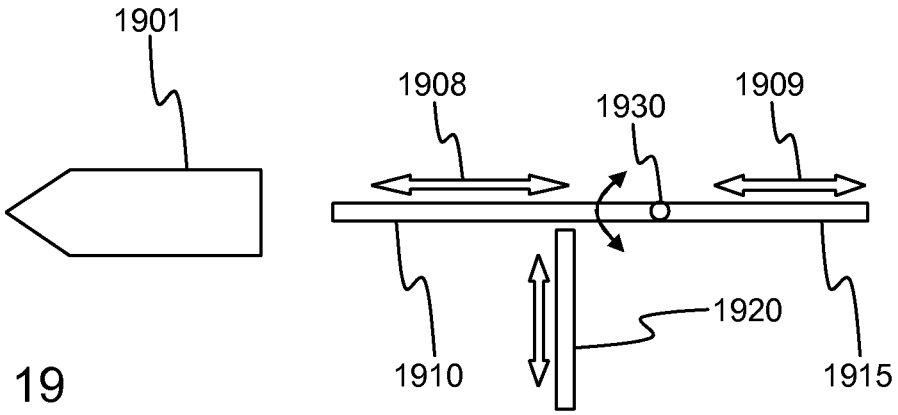
Figure 20:
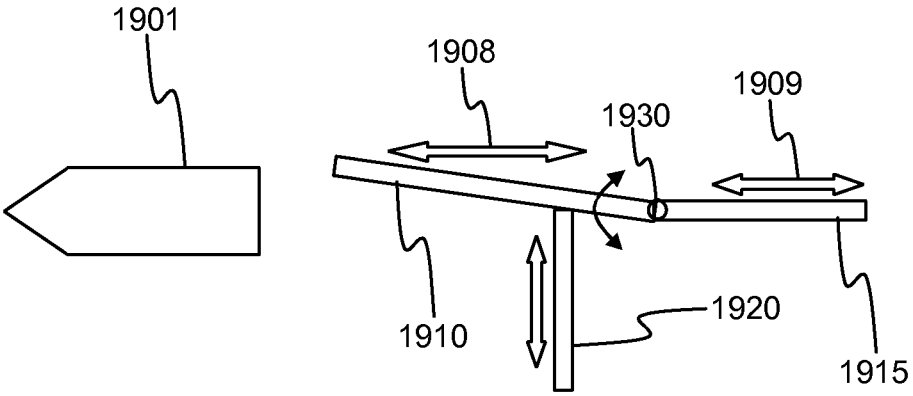

In FIG. 19, a firing pin of a firearm may comprise two or more portions, such as first portion 1910 and second portion 1915. The firing pin may move according to arrows 1908 and 1909 in a direction so that first portion 1910 may strike round (e.g., bullet) 1901. First portion 1910 may rotate relative to second portion 1915 about an axis or pin 1930, for example. A displacement element 1920 may move in a direction so as to rotate first pin portion 1910. Such rotation may lead to first pin portion no longer being in an alignment to strike round 1901 so as to discharge the round. Thus, displacement element 1920 may prevent firing pin portion 1910 from striking round 1901, thus preventing discharge of the firearm. FIG. 20 shows firing pin portion 1910 rotated and out of alignment for striking a part of round 1901 so as to discharge the round. An element such as 1920 may comprise a mechanical device, involving springs, gears, and so on. Also, an element such as 1920 may comprise a PZT that may change one or more of its dimensions (e.g., expand or contract) upon or after receiving an electrical signal, for example.

Figure 21:
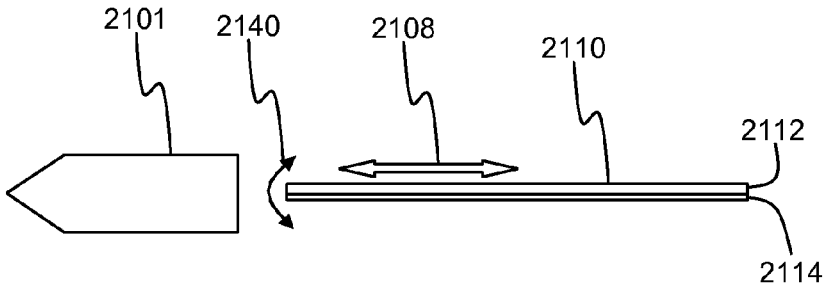
Figure 22:
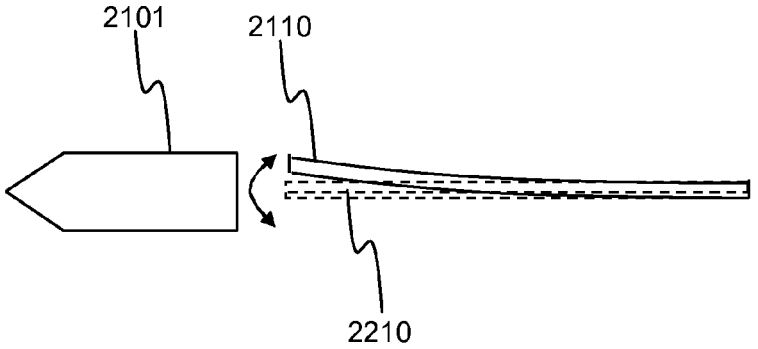

In FIG. 21, a firing pin 2110 of a firearm may comprise a bi-material (e.g., bimetal) thermocouple including two or more portions, such as first portion 2112 and second portion 2114. The firing pin may move according to arrow 2108 in a direction so that the firing pin may strike round (e.g., bullet) 2101. If first portion 2112 comprise a material with a different rate of thermal expansion compared to that of second portion 2114, then firing pin 2110 may bend or distort (such as indicated by arrow 2140) as shown in FIG. 22, for example. Number 2210 indicates an original shape of firing pin 2110 before bending. Such bending or distortion may lead to firing pin 2110 no longer being in an alignment to strike round 2101 so as to discharge the round. Thus, applying electricity to heat up the portions of firing pin 2110 may prevent firing pin 2110 from striking a particular portion (whether center-fire or rim-fire rounds are used) of round 2101, thus preventing discharge of the firearm.

Figure 23:
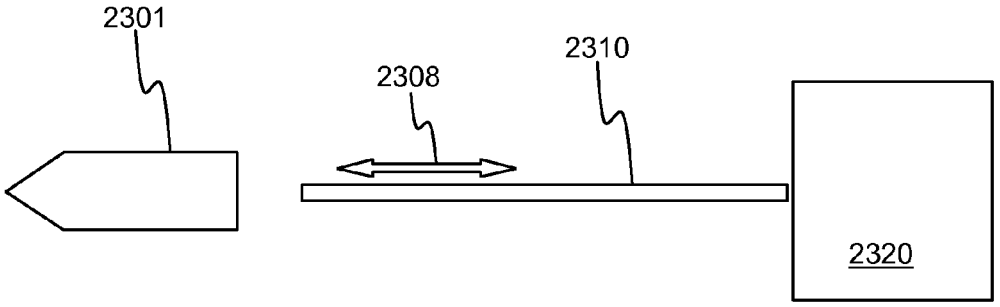

In FIG. 23, a firing pin 2310 of a firearm may move according to arrow 2308 in a direction so as to strike round (e.g., bullet) 2301. The embodiments shown in FIGS. 18-22 show examples of how mechanical manipulation may prevent a round from being discharged, even if a trigger of the firearm is pulled. Such examples of mechanical manipulation may be applied to a firing pin or any other part of a firing assembly of a firearm. There are many types of firearms, so different firing assemblies may require different techniques to prevent discharge of a round. Accordingly, block 2320 schematically represents example mechanisms or techniques that may be applied to any part of a firing mechanism of a firearm, in addition to the firing pin portions shown in the figures above. Claimed subject matter is not limited to any particular mechanics or techniques.

Figure 24:
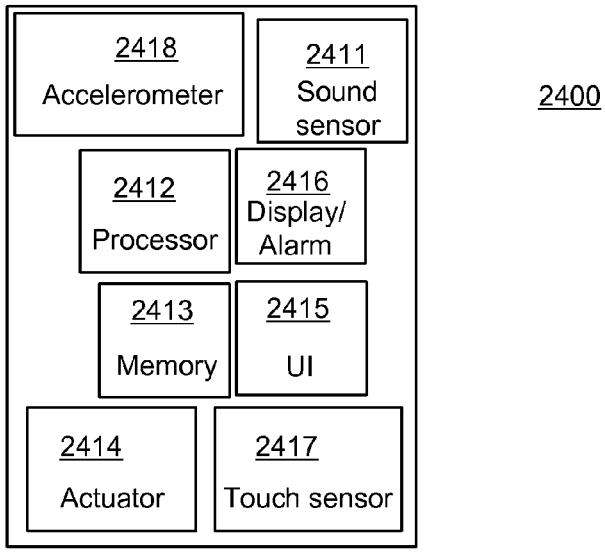
FIG. 24 is a schematic block diagram illustrating a system for performing a safety process associated with a firearm, according to another embodiment.

FIG. 24 is a schematic block diagram illustrating a system 2400 for performing a safety process associated with a firearm, such as process 1700, for example, according to an embodiment. For example, at least a portion of system 2400 may comprise an ADSD. System 2400 may comprise a sound or shock sensor 2411, a processor 2412, a memory 2413, an actuator 2414, a user interface (UI) 2415, a display/alarm 2416, a touch sensor 2417, and an accelerometer 2418. System 2400 may comprise further elements or may comprise fewer elements than are shown in FIG. 24, for example. Also, any elements of system 2400 may be co-located with one another or may be remotely located from one another. For example, a touch sensor may be remotely located from a processor or accelerometer, etc.

An accelerometer 2418 may be used to sense or detect orientation or position of a firearm. An accelerometer 2418 may also be used to sense kickback or shock from discharging a round (e.g., gunshot). For example, accelerometer 2418 may sense a position displacement of a firearm resulting from the firearm firing a round. Processor 2412 may use electronic signals generated by accelerometer 2418 to determine that the firearm discharged a round. In some implementations, sound sensor 2411 may be used by a processor to sense a gunshot using sound signatures stored in memory 2413, for example. In some implementations, accelerometer 2418 and sound sensor 2411 may comprise a single element, such as if sound sensor 2411 detects shock waves, for example. In one implementation, an ADSD, which may comprise a portion of system 2400, may learn a sound signature of gunshots. For example, a user may set a particular operation mode where the ADSD "listens" for a gunshot and records the sound signature of the gunshot. The ADSD may quantify the sound into a signature that is stored in memory and used to compare with subsequent gunshot sounds, for example. In another implementation, an ADSD may learn a sound signature of a round being loaded into a chamber of a firearm. For example, a user may set a particular operation mode where the ADSD "listens" for a round being loaded into a chamber of a firearm and records the sound signature of the round being loaded. The ADSD may quantify the sound into a signature that is stored in memory and used to compare with subsequent sounds of rounds being loaded, for example.

Touch sensor 2417 may comprise a trigger finger rest pad and may detect whether a finger is touching it. Touch sensor 2417 may provide electrical signals to processor 2412 that indicate to the processor whether or not a finger is touching the touch sensor. Processor 2412 may then execute code to respond any of a number of particular ways. For example, if an aim direction violates safety criteria but a finger is touching touch sensor 2417, which may mean that there is no finger on a trigger, then processor 2412 need not initiate an alarm. On the other hand, if an aim direction violates safety criteria and a finger is not touching touch sensor 2417, which may mean that there is a finger on a trigger, then processor 2412 may initiate an alarm. In one implementation, touch sensor 2417 may comprise part of a trigger so that a signal from such a touch sensor may indicate whether a finger is touching the trigger or not.

Display/alarm 2416 may comprise an audio alarm, such as a speaker. 2416 may also comprise one or more LEDs so that a visual alarm may comprise a lit LED, for example. Display/alarm 2416 may comprise a visual display, such as an LCD display, which may be used to display various things, such as battery level, system status, aim angle relative to a reference aim angle, number of shots fired (e.g., number of shots detected), and so on. If a portion of system 2400 comprises a smartphone, then Display/alarm 2416 may comprise a touchscreen display and speaker of the smartphone, for example.

Memory 2413 may store sound signatures, such as for rounds being loaded into a firing chamber of a firearm, gunshots from one or more firearms, and so on. Memory 2413 may also store safety criteria for a number of venues or circumstances. Memory 2413 may also store details of shooting history, for example.

A user interface 2415 may include a keypad, mouse, or touchscreen by which a user may provide operational instructions to system 2400. UI 2415 may comprise a visual display, such as an LCD display, which may be used to display various things, such as battery level, system status, aim angle relative to a reference aim angle, number of shots fired (e.g., number of shots detected), and so on. UI 2415 may also comprise buttons, switches, etc., such as buttons 1520 and 1620 shown in FIGS. 15 and 16, for example. If a portion of system 2400 comprises a smartphone, then UI 2415 may comprise a touchscreen display, for example.

An actuator 2414, which may be operated by processor 2412, may be used to manipulate a firing mechanism of a firearm so as to prevent the firearm from being able to fire a round. Some embodiments are shown in FIGS. 18-23, for example. Actuator 2414 may be located remotely from a remainder of system 2400, and may be powered by a battery. For example, actuator 2414 may be located in or near a firing mechanism of a firearm. A processor 2412 of system 2400 may communicate with remote actuator via wireless or wired communication, depending if the processor is also mounted to a portion of the firearm.

In one embodiment, at least a portion of system 2400 may record gunshots to develop a firing history. For example, time of day and aim direction of individual shots may be recorded and saved in memory to develop a shooting history Aim violations may also be recorded to develop a history of aim violations, which may include time of day and aim angle of individual violations. In one implementation, for example, portions of system 2400 may comprise a smartphone, touchpad, laptop, etc. In one example, a smartphone, laptop, server, etc. may be used to monitor shooting of multiple shooters at the same time. For example, Bluetooth technology may be used to wirelessly transmit signals among multiple sensors respectively attached to multiple firearms and one or more ADSDs, comprising a server, laptop, or smartphone or dedicated unit. Acting as an ADSD, a smartphone may be located remotely from a firearm, such as in a shooter's pocket, and so on. The smartphone may include a microphone comprising a sound or shock sensor 2411. An accelerometer 2418 may be located (e.g., attached) to the firearm. The accelerometer may communicate to the smartphone wirelessly. In one implementation, an initial gunshot may be used to set a reference aim direction. For example, the smartphone may detect a gunshot and also receive electronic wireless signals from an accelerometer attached on the firearm. A processor of the smartphone may set a reference aim direction based, at least in part, on the aim direction of the firearm at the time the gunshot was fired. The smartphone may detect subsequent gunshots from the firearm, identifying the gunshots, perhaps, by their sound signature. The smartphone may record the time of day of the individual gunshots and the aim direction of the individual gunshots. The aim direction may be ascertained since the smartphone may receive electronic wireless signals from the accelerometer (at some sampling rate) indicating orientation, and thus aim angle, of the firearm. The smartphone may save such measurements in memory 2413. Shooting history may be displayed via UI 2415, for example. Shooting history data may be uploaded from a smartphone via a micro-USB port or any other type of communication port, for example.

In one embodiment, an ADSD, which may comprise at least a portion of system 2400, may record gunshots to develop a firing history. For example, time of day and aim direction of individual shots may be recorded and saved in memory to develop a shooting history. Aim violations may also be recorded to develop a history of aim violations, which may include time of day and aim angle of individual violations. An ADSD may be located remotely from a firearm, such as in a shooter's pocket, and so on. The ADSD may include a microphone comprising a sound or shock sensor 2411. An accelerometer 2418 may be located (e.g., attached) to the firearm. The accelerometer may communicate to the ADSD wirelessly. In one implementation, an initial gunshot may be used to set a reference aim direction. For example, the ADSD may detect a gunshot and also receive electronic wireless signals from an accelerometer attached on the firearm. A processor of the ADSD may set a reference aim direction based, at least in part, on the aim direction of the firearm at the time the gunshot was fired. The ADSD may detect subsequent gunshots from the firearm, identifying the gunshots, perhaps, by their sound signature. The ADSD may record the time of day of the individual gunshots and the aim direction of the individual gunshots. The aim direction may be ascertained since the ADSD may receive electronic wireless signals from the accelerometer (at some sampling rate) indicating orientation, and thus aim angle, of the firearm. The ADSD may save such measurements in memory 2413. Shooting history may be displayed via UI 2415, for example. Shooting history data may be uploaded from an ADSD via a USB port or any other type of communication port, for example.

In one embodiment, an ADSD, which may comprise at least a portion of system 2400, may record gunshots to develop a firing history of multiple shooters at the same time. For example, time of day and aim direction of individual shots may be recorded and saved in memory to develop a shooting history of multiple users at the same time. Aim violations may also be recorded to develop a history of aim violations, which may include time of day and aim angle of individual violations. An ADSD may be located remotely from multiple firearms, such as at an observer station of a shooting range, and so on. The ADSD may include a microphone comprising a sound or shock sensor 2411. Accelerometers 2418 may be located (e.g., attached) to respective firearms. The accelerometers may communicate to the ADSD wirelessly. Individual accelerometers may be identified by unique electronic serial numbers or other coding, for example. In one implementation, an initial gunshot of individual firearms may be used to set a reference aim direction for the respective individual firearms. For example, the ADSD may detect a gunshot and also receive electronic wireless signals from an accelerometer attached on the firearm. A processor of the ADSD may set a reference aim direction based, at least in part, on the aim direction of the firearm at the time the gunshot was fired. The ADSD may detect subsequent gunshots from the particular firearm, identifying the gunshots, perhaps, by their sound signature. The ADSD may record the time of day of the individual gunshots of individual firearms and the aim direction of the individual gunshots. The aim direction may be ascertained since the ADSD may receive electronic wireless signals from the accelerometer (at some sampling rate) indicating orientation, and thus aim angle, of the firearm. The ADSD may save such measurements in memory 2413. Shooting history of multiple shooters on multiple firearms may be displayed via UI 2415, for example. Shooting history data may be uploaded from an ADSD via a USB port or any other type of communication port, for example.

Figure 25:
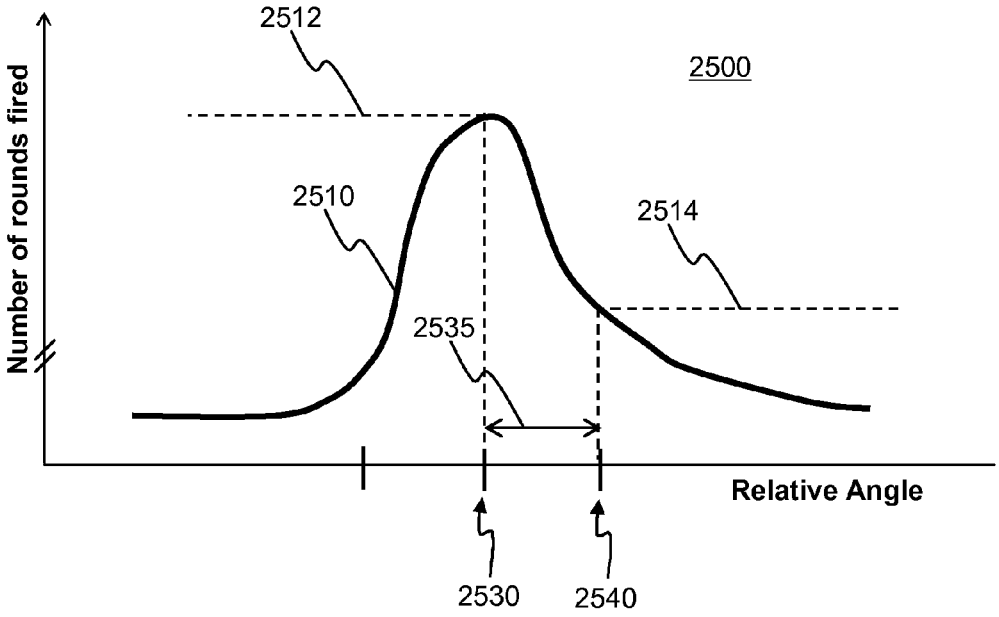
FIG. 25 is a distribution plot of aim direction, according to an embodiment.

FIG. 25 is a distribution plot 2510 of aim direction, according to an embodiment 2500. For example, plot 2510 may be produced from history data measured and recorded by a smartphone, as described above. As an example, plot 2510 may comprise one hundred data points comprising aim angle of the individual shots. For the plot, such aim angles may be referenced to a reference aim angle 2530. Plot 2510 may comprise a histogram of number of shots in angle range bins, for example. For instance, if a value 2512 comprise twenty, then plot 2510 indicates that twenty shots were fired while the firearm was aimed at the reference aim angle 2530. If a value 2514 comprises nine, then plot 2510 indicates that nine shots were fired while the firearm was aimed at an aim angle 2540, which may comprise an angle of displacement from the reference aim angle of 2535, for example.

In one implementation, which may be useful for practice aiming a firearm, an alarm may indicate if the firearm is aimed substantially toward a target. For example, after a reference aim direction is set and stored in memory, an LED may light if the aim direction is within a range of angles from the reference aim direction. For example, if the aim direction is within 2.0 degrees of the reference aim direction (which may be assumed to be the direction of a target), then an LED may light. Of course, other variables may be that an LED lights if aim direction is not in the angle range, etc. In one further implementation, a brightness of an LED may be based, at least in part, on aim direction relative to a reference aim direction. For example, the more true an aim is to a target, the brighter the LED may be. Of course, such details of system 2400 are merely examples, and claimed subject matter is not so limited.

Figure 26:
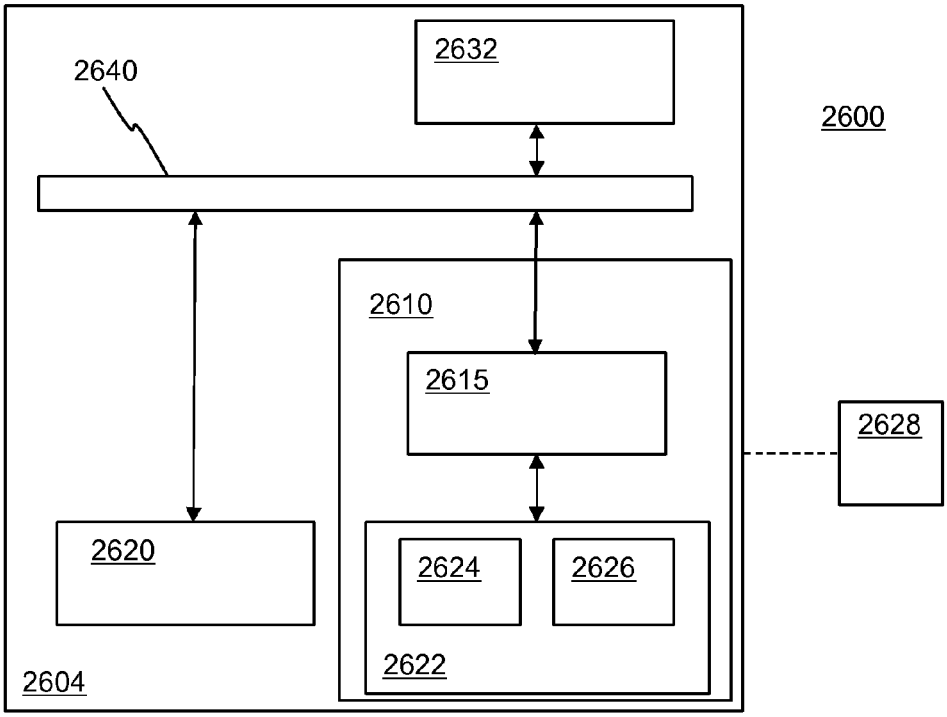
FIG. 26 is a schematic block diagram illustrating a computer system, according to an embodiment.

FIG. 26 is a schematic diagram illustrating an embodiment of a computing system 2600, for example, which may be included in an ADSD. Some portions of system 2600 may overlap with some portions of system 2400. System 2600 may be used to perform process 1700, for example. A computing device may comprise one or more processors, for example, to execute an application or other code. A computing device 2604 may be representative of any device, appliance, or machine that may be used to manage memory module 2610. Memory module 2610 may include a memory controller 2615 and a memory 2622. By way of example but not limitation, computing device 2604 may include: one or more computing devices or platforms, such as, e.g., a desktop computer, a laptop computer, a workstation, a server device, or the like; one or more personal computing or communication devices or appliances, such as, e.g., a personal digital assistant, mobile communication device, smartphone, touchpad, or the like; a computing system or associated service provider capability, such as, e.g., a database or information storage service provider or system; or any combination thereof.

It is recognized that all or part of the various devices shown in system 2600, and the processes and methods as further described herein, may be implemented using or otherwise including at least one of hardware, firmware, or software, other than software by itself. Thus, by way of example, but not limitation, computing device 2604 may include at least one processing unit 2620 that is operatively coupled to memory 2622 through a bus 2640 and a host or memory controller 2615. Processing unit 2620 is representative of one or more devices capable of performing at least a portion of a computing procedure or process, such as process 2000, for example. By way of example, but not limitation, processing unit 2620 may include one or more processors, microprocessors, controllers, application specific integrated circuits, digital signal processors, programmable logic devices, field programmable gate arrays, and the like, or any combination thereof. Processing unit 2620 may include an operating system to be executed that is capable of communication with memory controller 2615.

In one embodiment, processing unit 2620 may execute code to receive signals from a sound sensor and detect a sound signature of a gunshot from a firearm based, at least in part, on the signals from the sound sensor; receive signals from a 3D sensor, such as an accelerometer, and detect an aim direction of the firearm substantially at the time of detecting the sound signature of the gunshot; set a reference direction based, at least in part, on the aim direction; periodically receive signals from the 3D sensor to detect a current aim direction of the firearm; compare a current aim direction to the reference direction; and initiate an alarm if the current aim direction is beyond a threshold angle of displacement from the reference direction.

An operating system may, for example, generate commands to be sent to memory controller 2615 over or via bus 2640. Commands may comprise read or write commands, for example.

Memory 2622 is representative of any information storage mechanism. Memory may store rules or criteria, signals applied to a subject, output from detectors measuring parameters of a subject, and so on, as explained above. Memory 2622 may include, for example, a primary memory 2624 or a secondary memory 2626. Primary memory 2624 may include, for example, a random access memory, read only memory, etc. While illustrated in this example as being separate from processing unit 2620, it should be understood that all or part of primary memory 2624 may be provided within or otherwise co-located or coupled with processing unit 2620.

Secondary memory 2626 may include, for example, the same or similar type of memory as primary memory or one or more other types of information storage devices or systems, such as a disk drive, an optical disc drive, a tape drive, a solid state memory drive, etc. In certain implementations, secondary memory 2626 may be operatively receptive of, or otherwise capable of being operatively coupled to a computer-readable medium 2628. Computer-readable medium 2628 may include, for example, any medium that is able to store, carry, or make accessible readable, writable, or rewritable information, code, or instructions for one or more of device in system 2600. Computing device 2604 may include, for example, an input/output device or unit 2632.

Input/output unit or device 2632 is representative of one or more devices or features that may be capable of accepting or otherwise receiving signal inputs from a human or a machine, or one or more devices or features that may be capable of delivering or otherwise providing signal outputs to be received by a human or a machine. By way of example but not limitation, input/output device 2632 may include a display, speaker, keyboard, mouse, trackball, touchscreen, etc.

Figure 27:
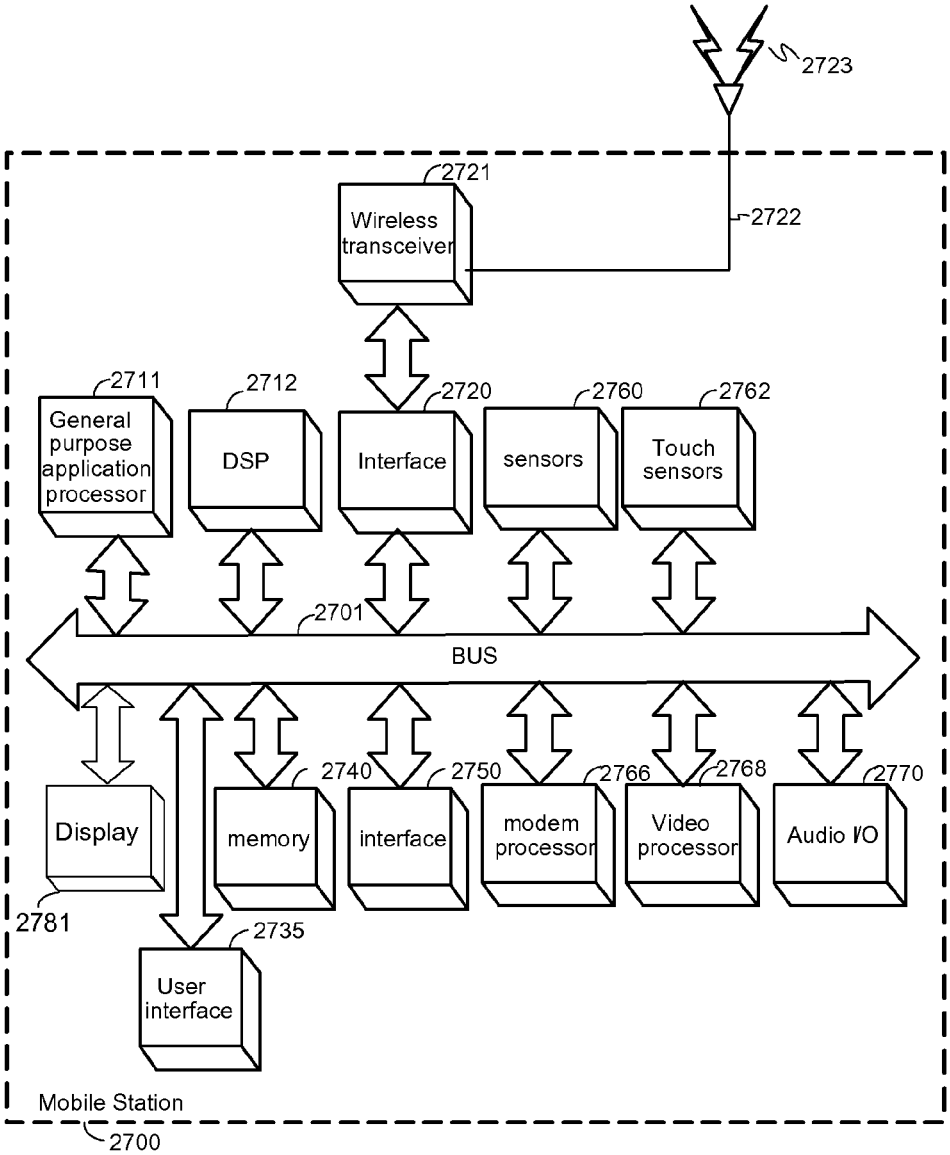
FIG. 27 is a schematic diagram of a portion of an ADSD according to an embodiment.

FIG. 27 is a schematic diagram of a portion of an ADSD according to an embodiment. ADSD 2700 may comprise one or more features of a system 2400 shown in FIG. 24, for example. In certain embodiments, processes such as 1700, for example, may be implemented using elements included in ADSD 2700. For example, ADSD 2700 may comprise a wireless transceiver 2721 which is capable of transmitting and receiving wireless signals 2723 via an antenna 2722. Wireless transceiver 2721 may be connected to bus 2701 by a wireless transceiver bus interface 2720. Wireless transceiver bus interface 2720 may, in some embodiments be at least partially integrated with wireless transceiver 2721. Some embodiments may include multiple wireless transceivers 2721 and wireless antennas 2722 to enable transmitting and/or receiving signals according to a corresponding multiple wireless communication standards such as, for example, WiFi, CDMA, WCDMA, LTE and Bluetooth, just to name a few examples.

In some embodiments, general-purpose processor(s) 2711, memory 2740, DSP(s) 2712 and/or specialized processors (not shown) may also be utilized to process signals acquired via transceivers 2721.

Also shown in FIG. 27, ADSD 2700 may comprise digital signal processor(s) (DSP(s)) 2712 connected to the bus 2701 by a bus interface 2710, general-purpose processor(s) 2711 connected to the bus 2701 by a bus interface 2710 and memory 2740. Bus interface 2710 may be integrated with the DSP(s) 2712, general-purpose processor(s) 2711 and memory 2740. In various embodiments, functions or processes, such as processes 1700 shown in FIG. 17, for example, may be performed in response to execution of one or more machine-readable instructions stored in memory 2740 such as on a computer-readable storage medium, such as RAM, ROM, FLASH, or disc drive, just to name a few example. The one or more instructions may be executable by general-purpose processor(s) 2711, specialized processors, or DSP(s) 2712.

In one implementation, for example, one or more machine-readable instructions stored in memory 2740 may be executable by a processor(s) 2711 to perform processes such as process 1700. In another implementation, for example, one or more machine-readable instructions stored in memory 2740 may be executable by a processor(s) 2711 to: receive signals from a sound sensor and detect a sound signature of a gunshot from a firearm based, at least in part, on the signals from the sound sensor; receive signals from a 3D sensor, such as an accelerometer, and detect an aim direction of the firearm substantially at the time of detecting the sound signature of the gunshot; set a reference direction based, at least in part, on the aim direction; periodically receive signals from the 3D sensor to detect a current aim direction of the firearm; compare a current aim direction to the reference direction; and initiate an alarm if the current aim direction is beyond a threshold angle of displacement from the reference direction.

Memory 2740 may comprise a non-transitory processor-readable memory and/or a computer-readable memory that stores software code (programming code, instructions, etc.) that are executable by processor(s) 2711 and/or DSP(s) 2712 to perform functions described herein.

Also shown in FIG. 27, a user interface 2735 may comprise any one of several devices such as, for example, a speaker, microphone, display device, vibration device, keyboard, touch screen, just to name a few examples. In a particular implementation, user interface 2735 may enable a user to interact with one or more applications hosted on ADSD 2700. For example, devices of user interface 2735 may store analog or digital signals on memory 2740 to be further processed by DSP(s) 2712 or general purpose processor 2711 in response to action from a user. Similarly, applications hosted on ADSD 2700 may store analog or digital signals on memory 2740 to present an output signal to a user. In another implementation, ADSD 2700 may optionally include a dedicated audio input/output (I/O) device 2770 comprising, for example, a dedicated speaker, microphone, digital to analog circuitry, analog to digital circuitry, amplifiers and/or gain control. It should be understood, however, that this is merely an example of how an audio I/O may be implemented in an ADSD, and that claimed subject matter is not limited in this respect. In another implementation, ADSD 2700 may comprise touch sensors 2762 responsive to touching or pressure on a keyboard or touch screen device.

ADSD 2700 may also comprise sensors 2760 coupled to bus 2701 which may include, for example, inertial sensors and environment sensors that may be used to detect sounds, firearm orientations, and so on, as described above. Inertial sensors of sensors 2760 may comprise, for example accelerometers (e.g., collectively responding to acceleration of a firearm in three dimensions), one or more gyroscopes, or one or more magnetometers (e.g., to support one or more compass applications). Environment sensors of ADSD 2700 may comprise, for example, temperature sensors, capacitive touch sensors, ambient light sensors, camera imagers, and microphones, just to name few examples. Sensors 2760 may generate analog or digital signals that may be stored in memory 2740 and processed by DPS(s) or general purpose processor 2711 in support of one or more applications such as, for example, applications directed to positioning or navigation operations.

In a particular implementation, ADSD 2700 may comprise a dedicated modem processor 2766 capable of performing baseband processing of signals received and downconverted at wireless transceiver 2721 or SPS receiver 2755. Similarly, modem processor 2766 may perform baseband processing of signals to be upconverted for transmission by wireless transceiver 2721. In alternative implementations, instead of having a dedicated modem processor, baseband processing may be performed by a general purpose processor or DSP (e.g., general purpose/application processor 2711 or DSP(s) 2712). It should be understood, however, that these are merely examples of structures that may perform baseband processing, and that claimed subject matter is not limited in this respect.

Figure 28:
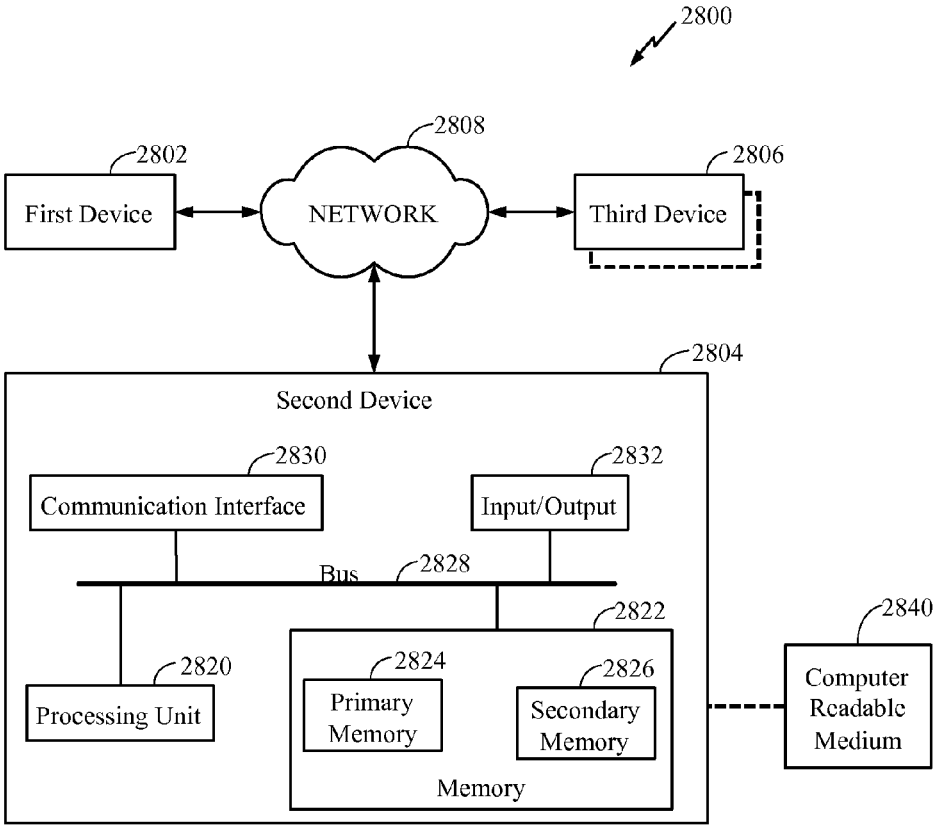
FIG. 28 is a schematic diagram illustrating an example system that may include one or more devices configurable to implement techniques or processes.

FIG. 28 is a schematic diagram illustrating an example system 2800 that may include one or more devices configurable to implement techniques or processes, such as process 1700 described above, for example, in connection with FIG. 17. System 2800 may include, for example, a first device 2802, a second device 2804, and a third device 2806, which may be operatively coupled together through a wireless communications network 2808. Such devices may comprise an ADSD, a touch sensor, an actuator, a 3D sensor, and so on.

First device 2802, second device 2804 and third device 2806, as shown in FIG. 28, may be representative of any device, appliance or machine that may be configurable to exchange data over wireless communications network 2808, which may comprise empty space (e.g., hardware need not be included). By way of example but not limitation, any of first device 2802, second device 2804, or third device 2806 may include: one or more computing devices or platforms, such as, e.g., a desktop computer, a laptop computer, a workstation, a server device, or the like; one or more personal computing or communication devices or appliances, such as, e.g., a personal digital assistant, mobile communication device, or the like; a computing system or associated service provider capability, such as, e.g., a database or data storage service provider/system, a network service provider/system, an Internet or intranet service provider/system, a portal or search engine service provider/system, a wireless communication service provider/system; one or more sensors, actuators, detectors; or any combination thereof.

Similarly, wireless communications network 2808, as shown in FIG. 28, is representative of one or more communication links, processes, or resources configurable to support the exchange of data between at least two of first device 2802, second device 2804, and third device 2806. By way of example but not limitation, wireless communications network 2808 may include wireless or wired communication links, telephone or telecommunications systems, data buses or channels, optical fibers, terrestrial or space vehicle resources, local area networks, wide area networks, intranets, the Internet, routers or switches, and the like, or any combination thereof. As illustrated, for example, by the dashed lined box illustrated as being partially obscured of third device 2806, there may be additional like devices operatively coupled to wireless communications network 2808.

It is recognized that all or part of the various devices and networks shown in system 2800, and the processes and methods as further described herein, may be implemented using or otherwise including hardware, firmware, software, or any combination thereof.

Thus, by way of example but not limitation, second device 2804 may include at least one processing unit 2820 that is operatively coupled to a memory 2822 through a bus 2828. In one implementation, for example, one or more machine-readable instructions stored in memory 2822 may be executable by processing unit 2820 to: receive signals from a sound sensor and detect a sound signature of a gunshot from a firearm based, at least in part, on the signals from the sound sensor; receive signals from a 3D sensor, such as an accelerometer, and detect an aim direction of the firearm substantially at the time of detecting the sound signature of the gunshot; set a reference direction based, at least in part, on the aim direction; periodically receive signals from the 3D sensor to detect a current aim direction of the firearm; compare a current aim direction to the reference direction; and initiate an alarm if the current aim direction is beyond a threshold angle of displacement from the reference direction.

Processing unit 2820 is representative of one or more circuits configurable to perform at least a portion of a data computing procedure or process. By way of example but not limitation, processing unit 2820 may include one or more processors, controllers, microprocessors, microcontrollers, application specific integrated circuits, digital signal processors, programmable logic devices, field programmable gate arrays, and the like, or any combination thereof. In certain embodiments, processes such 1700, for example, may be performed by processing unit 2820. In other embodiments, input/output 2832 may provide a means for obtaining measurements of one or more sensors located on a firearm via wireless signals by an ADSD while located in a signal environment.

Memory 2822 is representative of any data storage mechanism. Memory 2822 may include, for example, a primary memory 2824 or a secondary memory 2826. Primary memory 2824 may include, for example, a random access memory, read only memory, etc. While illustrated in this example as being separate from processing unit 2820, it should be understood that all or part of primary memory 2824 may be provided within or otherwise co-located/coupled with processing unit 2820.

Secondary memory 2826 may include, for example, the same or similar type of memory as primary memory or one or more data storage devices or systems, such as, for example, a disk drive, an optical disc drive, a tape drive, a solid state memory drive, etc. In certain implementations, secondary memory 2826 may be operatively receptive of, or otherwise configurable to couple to, a computer-readable medium 2840. Computer-readable medium 2840 may include, for example, any non-transitory medium that can carry or make accessible data, code or instructions for one or more of the devices in system 2800. Computer-readable medium 2840 may also be referred to as a storage medium.

Second device 2804 may include, for example, a communication interface 2830 that provides for or otherwise supports the operative coupling of second device 2804 to at least wireless communications network 2808. By way of example but not limitation, communication interface 2830 may include a network interface device or card, a modem, a router, a switch, a transceiver, and the like.

Second device 2804 may include, for example, an input/output device 2832. Input/output device 2832 is representative of one or more devices or features that may be configurable to accept or otherwise introduce human or machine inputs, or one or more devices or features that may be configurable to deliver or otherwise provide for human or machine outputs. By way of example but not limitation, input/output device 2832 may include an operatively configured display, speaker, keyboard, mouse, trackball, touch screen, data port, etc.

The methodologies described herein may be implemented by various means depending upon applications according to particular examples. For example, such methodologies may be implemented in hardware, firmware, software, or combinations thereof. In a hardware implementation, for example, a processing unit may be implemented within one or more application specific integrated circuits ("ASICs"), digital signal processors ("DSPs"), digital signal processing devices ("DSPDs"), programmable logic devices ("PLDs"), field programmable gate arrays ("FPGAs"), processors, controllers, micro-controllers, microprocessors, electronic devices, other devices units designed to perform the functions described herein, or combinations thereof.

Some portions of the detailed description included herein are presented in terms of algorithms or symbolic representations of operations on binary digital signals stored within a memory of a specific apparatus or special purpose computing device or platform. In the context of this particular specification, the term specific apparatus or the like includes a general purpose computer once it is programmed to perform particular operations pursuant to instructions from program software. Algorithmic descriptions or symbolic representations are examples of techniques used by those of ordinary skill in the signal processing or related arts to convey the substance of their work to others skilled in the art. An algorithm is here, and generally, is considered to be a self-consistent sequence of operations or similar signal processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals, or the like. It should be understood, however, that all of these or similar terms are to be associated with appropriate physical quantities and are merely convenient labels. Unless specifically stated otherwise, as apparent from the discussion herein, it is appreciated that throughout this specification discussions utilizing terms such as "processing," "computing," "calculating," "determining" or the like refer to actions or processes of a specific apparatus, such as a special purpose computer, special purpose computing apparatus or a similar special purpose electronic computing device. In the context of this specification, therefore, a special purpose computer or a similar special purpose electronic computing device is capable of manipulating or transforming signals, typically represented as physical electronic or magnetic quantities within memories, registers, or other information storage devices, transmission devices, or display devices of the special purpose computer or similar special purpose electronic computing device.

Wireless communication techniques described herein may be in connection with various wireless communications networks such as a wireless wide area network ("WWAN"), a wireless local area network ("WLAN"), a wireless personal area network (WPAN), and so on. The term "network" and "system" may be used interchangeably herein. A WWAN may be a Code Division Multiple Access ("CDMA") network, a Time Division Multiple Access ("TDMA") network, a Frequency Division Multiple Access ("FDMA") network, an Orthogonal Frequency Division Multiple Access ("OFDMA") network, a Single-Carrier Frequency Division Multiple Access ("SC-FDMA") network, or any combination of the above networks, and so on. A CDMA network may implement one or more radio access technologies ("RATs") such as cdma2000, Wideband-CDMA ("W-CDMA"), to name just a few radio technologies. Here, cdma2000 may include technologies implemented according to IS-95, IS-2000, and IS-856 standards. A TDMA network may implement Global System for Mobile Communications ("GSM"), Digital Advanced Mobile Phone System ("D-AMPS"), or some other RAT. GSM and W-CDMA are described in documents from a consortium named "3rd Generation Partnership Project" ("3GPP"). Cdma2000 is described in documents from a consortium named "3rd Generation Partnership Project 2" ("3GPP2"). 3GPP and 3GPP2 documents are publicly available. 4G Long Term Evolution ("LTE") communications networks may also be implemented in accordance with claimed subject matter, in an aspect. A WLAN may comprise an IEEE 802.11x network, and a WPAN may comprise a Bluetooth network, an IEEE 802.15x, for example. Wireless communication implementations described herein may also be used in connection with any combination of WWAN, WLAN or WPAN.

In another aspect, as previously mentioned, a wireless transmitter or access point may comprise a femto cell, utilized to extend cellular telephone service into a business or home. In such an implementation, one or more ADSDs may communicate with a femto cell via a code division multiple access ("CDMA") cellular communication protocol, for example, and the femto cell may provide the ADSD access to a larger cellular telecommunication network by way of another broadband network such as the Internet.

It will, of course, be understood that, although particular embodiments have just been described, claimed subject matter is not limited in scope to a particular embodiment or implementation. For example, one embodiment may be in hardware, such as implemented on a device or combination of devices, for example. Likewise, although claimed subject matter is not limited in scope in this respect, one embodiment may comprise one or more articles, such as a storage medium or storage media that may have stored thereon instructions capable of being executed by a specific or special purpose system or apparatus, for example, to lead to performance of an embodiment of a method in accordance with claimed subject matter, such as one of the embodiments previously described, for example. However, claimed subject matter is, of course, not limited to one of the embodiments described necessarily. Furthermore, a specific or special purpose computing platform may include one or more processing units or processors, one or more input/output devices, such as a display, a keyboard or a mouse, or one or more memories, such as static random access memory, dynamic random access memory, flash memory, or a hard drive, although, again, claimed subject matter is not limited in scope to this example.

The terms, "and" and "or" as used herein may include a variety of meanings that will depend at least in part upon the context in which it is used. Typically, "or" or "and/or" if used to associate a list, such as A, B or C, is intended to mean A, B, and C, here used in the inclusive sense, as well as A, B or C, here used in the exclusive sense. Embodiments described herein may include machines, devices, engines, or apparatuses that operate using digital signals. Such signals may comprise electronic signals, optical signals, electromagnetic signals, or any form of energy that provides information between locations.

In the description herein, various aspects of claimed subject matter have been described. For purposes of explanation, specific numbers, systems, or configurations may have been set forth to provide a thorough understanding of claimed subject matter. However, it should be apparent to one skilled in the art having the benefit of this disclosure that claimed subject matter may be practiced without those specific details. In other instances, features that would be understood by one of ordinary skill were omitted or simplified so as not to obscure claimed subject matter.

While there has been illustrated and described what are presently considered to be example embodiments, it will be understood by those skilled in the art that various other modifications may be made, and equivalents may be substituted, without departing from claimed subject matter. Additionally, many modifications may be made to adapt a particular situation to the teachings of claimed subject matter without departing from the central concept described herein. Therefore, it is intended that claimed subject matter not be limited to the particular embodiments disclosed, but that such claimed subject matter may also include all embodiments falling within the scope of the appended claims, and equivalents thereof.

What is claimed is:

1. A method for detecting a shooter's aim or pointing direction of a firearm, the method comprising:

using a sound detector to detect a sound signature of a gunshot from said firearm;

using a 3D sensor to sense an aim direction of said firearm substantially at the time of detecting said sound signature of said gunshot;

using electronics or a processor to set a reference direction based, at least in part, on said aim direction;

sense a current aim direction of said firearm;

compare said current aim direction to said reference direction; and initiate an alarm if said current aim direction is beyond a threshold angle of displacement from said reference direction.

2. The method of claim 1, wherein an intensity of said alarm is based, at least in part, on an angle of displacement from said reference direction.

3. The method of claim 1, further comprising detecting a sound signature of a round being loaded into a chamber of said firearm.

4. The method of claim 3, wherein an intensity of said alarm is based, at least in part, on said detecting said sound signature of said round being loaded into said chamber of said firearm.

5. The method of claim 1, further comprising using a finger placement detector to detect if a finger of a user is on or near a trigger of said firearm.

6. The method of claim 5, wherein an intensity of said alarm is based, at least in part, on said detecting if said finger is on or near said trigger of said firearm.

7. The method of claim 1, further comprising receiving instructions from a user to set or reset said threshold angle of displacement.

8. The method of claim 1, further comprising recording history of aim violations.

9. The method of claim 1, further comprising updating said reference direction based, at least in part, on a subsequent gunshot.

10. The method of claim 1, further comprising defeating shooting capability of said firearm based, at least in part, on said angle of displacement from said reference direction.

11. A device for detecting a shooter's aim or pointing direction of a firearm, the device comprising:

a sound detector to detect a sound of a gunshot from said firearm;

a 3D sensor to sense an aim direction of said firearm; and a processor or electronics to:

set a reference direction based, at least in part, said aim direction at a time when said sound of said gunshot is detected;

compare a current aim direction to said reference direction; and initiate an alarm if said current aim direction is beyond a threshold angle of displacement from said reference direction.

12. The device of claim 11, wherein said processor or electronics changes an intensity of said alarm based, at least in part, on an angle of displacement from said reference direction.

13. The device of claim 11, wherein said sound detector is further configured to detect a sound signature of a round being loaded into a chamber of said firearm.

14. The device of claim 13, wherein said processor or electronics are capable of learning said sound signature of said round being loaded into said chamber of said firearm.

15. The device of claim 11, further comprising a finger placement detector to detect if a finger of a user is on or near a trigger of said firearm.

16. The device of claim 11, further comprising a rest pad for a finger of a user, wherein said processor or electronics is configured to detect if said finger is contacting a rest pad.

17. The device of claim 11, wherein said processor or electronics are capable of updating said reference direction based, at least in part, on a subsequent gunshot.

18. The device of claim 11, wherein said processor or electronics are capable of uploading histories stored in a memory to an electronic device, wherein said histories comprise a history of gunshots and/or a history of aim violations.

19. The device of claim 11, wherein said processor or electronics are capable of defeating shooting capability of said firearm based, at least in part, on said angle of displacement from said reference direction.

20. A non-transitory storage medium comprising machine-readable instructions stored thereon that are executable by a special purpose computing device to:

identify a sound signature of a gunshot from said firearm;

determine an aim direction of said firearm substantially at the time of identifying said sound signature of said gunshot;

set a reference direction based, at least in part, on said aim direction;

determine a current aim direction of said firearm;

compare said current aim direction to said reference direction; and initiate an alarm if said current aim direction is beyond a threshold angle of displacement from said reference direction.

* * * * *